US005643051A

United States Patent [19]

Zhou et al.

[11] Patent Number: 5,643,051

[45] Date of Patent: Jul. 1, 1997

[54] CENTERLESS GRINDING PROCESS AND APPARATUS THEREFOR

[75] Inventors: Shiping Steven Zhou, Shrewsbury, Mass.; Joseph R. Gartner, Willington; Trevor D. Howes, Mansfield Center, both of Conn.

[73] Assignee: The University of Connecticut, Storrs, Conn.

[21] Appl. No.: 491,027

[22] Filed: Jun. 16, 1995

[51] Int. Cl.[6] ..... B24B 49/00

[52] U.S. Cl. ..... 451/11; 451/242; 451/243; 451/5; 451/407

[58] Field of Search ..... 451/245, 242, 451/243, 244, 5, 407, 408, 10, 11

[56] References Cited

U.S. PATENT DOCUMENTS

| | | | |
|---|---|---|---|
| 3,079,741 | 3/1963 | Render | 451/243 |
| 3,449,867 | 6/1969 | Lindsay et al. | 451/242 |
| 3,967,515 | 7/1976 | Nachtigal et al. | 451/242 |
| 4,570,387 | 2/1986 | Unno et al. | 451/242 |
| 4,604,834 | 8/1986 | Thompson | 451/5 |
| 4,712,332 | 12/1987 | Smith | 451/244 |
| 4,926,603 | 5/1990 | Frost et al. | 451/11 |

OTHER PUBLICATIONS

An Experimental Investigation of Workpiece Out–of–roundness in Centerless Grinding S. Steven Zhou and Joseph R. Gartner (Oct. 1994).

Lobing Control In Centerless Grinding Society of Manufacturing Engineers (1988) Dr. Martin Frost, Bruce J. Horton, Jonathan L. Tidd.

A Practical Method To Reduce The Workpiece Surface Waviness In Centerless Grinding Society of Manufacturing Engineers (1993) S. Steven Zhou, Zhongzue Gan, Joseph R. Gartner.

*Primary Examiner*—James G. Smith
*Assistant Examiner*—Dona C. Edwards
*Attorney, Agent, or Firm*—Pepe & Hazard

[57] ABSTRACT

In a method for minimizing the roundness error in an workpiece having a generally circular periphery during centerless grinding of the workpiece, the workpiece is rotatably supported on the upper surface of a first workpiece support between the grinding wheel and the second workpiece support, with the first support rotatably supporting the workpiece in contact with said grinding wheel and said second support. The α-setup angle and β-setup angle cooperate with a cutting ratio to define the transfer function of a lobing loop system in the complex u-plane, and the lobing stability of the lobing loop system is thereby determined. The workpiece is rotated against the rotating grinding surface of the grinding wheel, and the magnitude and frequency of grinding disturbances causing the roundness error in the workpiece are detected. The β-setup angle is modified to minimize the workpiece roundness error by minimizing the response of the lobing loop system corresponding to the detected grinding disturbances, and the ratio of the rotational speed of the grinding wheel to the rotational speed of the workpiece is adjusted to further minimize the workpiece roundness error by generating only precessing waves of minimum magnitude in the workpiece.

17 Claims, 31 Drawing Sheets

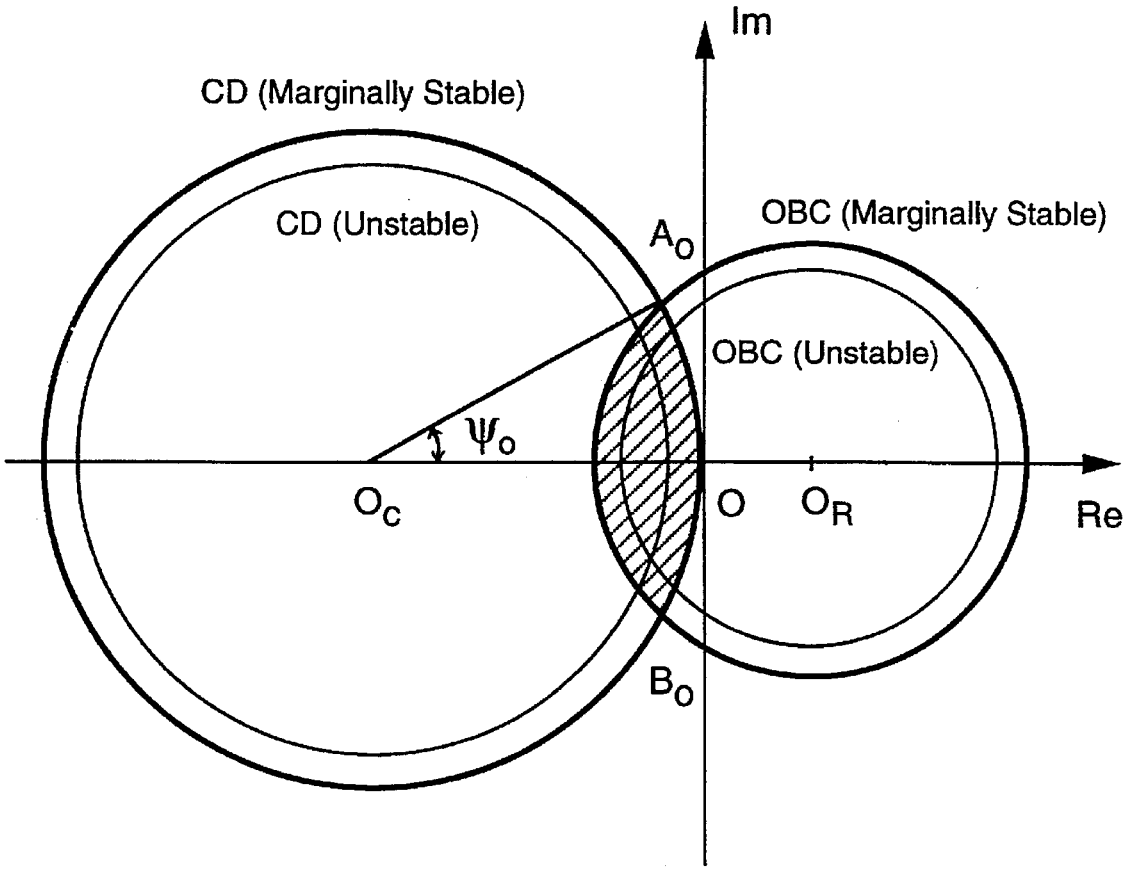
FIUGURE 14

CENTERLESS GRINDING PROCESS AND APPARATUS THEREFOR

BACKGROUND OF THE INVENTION

The present invention relates to centerless grinding, and more particularly, to a novel process and apparatus for minimizing the roughness error in the workpiece in such centerless grinding.

In centerless grinding the workpiece is not held at a fixed rotational axis, but is rotatably constrained about its periphery during grinding. Such a centerless workpiece setup can generally hold a tight part-to-part tolerance, provide a stiff support across the length of the workpiece, and be easily adapted to continuous through feed with zero loading time. Thus, centerless grinding has been viewed as one of the most efficient and rapid means of producing precision surface finishes on cylindrical components. The basic elements of a plunge centerless grinding system include a workpiece which is constrained by a grinding wheel, regulating wheel, and support blade. Moreover, the centerless grinding system is characterized mathematically by the machine setup including the cutting ratio K, and setup angles $\alpha$ and $\beta$ which are used to describe the contact positions between the workpiece and the grinding wheel, regulating wheel, and support blade.

One of the main difficulties in industrial applications of centerless grinding is that the quality of the ground workpiece is often adversely affected by the surface waves generated in the workpiece during grinding, causing the workpiece to be out-of-round. The problem of workpiece out-of-roundness in centerless grinding was recognized more than half a century ago. The cause of such a problem can be explained partially by the fact that the workpiece is supported about its periphery.

The tendency to generate workpiece roundness error results primarily from the geometry of the workpiece setup itself. Surface irregularities in the workpiece coming into contact with the regulating wheel or support blade will cause the workpiece center to move away from its original position. These movements of the workpiece center cause the grinding wheel to produce additional surface irregularities in the workpiece. The inherent tendency of regenerating the workpiece surface irregularities causes centerless grinding to be more susceptible to workpiece out-of-roundness than center-type grinding. In fact, workpiece out-of-roundness in centerless grinding is one of the main limitations of the centerless grinding process as a high rate and high precision process.

Choosing proper setup angles $\alpha$ and $\beta$ in order to control the workpiece roundness error has been of critical importance to the industry since the early years of centerless grinding. The state of the art in selecting the proper setup angles $\alpha$ and $\beta$ still largely relies on a machinist's trial and error procedure, and centerless grinding is often viewed as an unpredictable process or an art rather than a science. Most of the existing analyses address only one particular aspect of the workpiece out-of-roundness problem, and a general approach to the problem is not available.

Exemplary of a single variable approach is Unno et al U.S. Pat. No. 4,570,387 in which a conventional centerless grinding machine keeps the throat angle, $\beta$, at a constant, e.g., at 7 degrees. The constant throat angle is maintained by adjusting the workpiece center height to compensate the changes of the grinding and regulating wheel diameters, and workpiece diameter. A constant throat angle, however, does not assure improved workpiece roundness.

Another example of a single variable approach is Frost et al U.S. Pat. No. 4,926,603 in which a conventional centerless grinding machine detects the periodic irregularities on the periphery of the workpiece during grinding, and periodically modifies the workpiece center height by adjusting the height of the support blade to eliminate the surface irregularities. However, adjusting the blade height during grinding alone can not always effectively eliminate the irregularities and may introduce additional surface irregularities.

It is widely recognized that the setup angles $\alpha$ and $\beta$ play an important role in the workpiece rounding process, and a mathematical model, known as the rounding mechanism, has been developed to describe the geometric effect of the centerless workpiece setup.

Although progress in the field has been made by the formulation of the rounding mechanism, this mechanism is incomplete due to the fact that the surface wave generation process is influenced not only by the geometrical effect of the centerless workpiece setup, but also by the regenerative effect of the cutting process, the dynamic effect of the machine structure, and various types of grinding disturbances occurring during grinding. Thus, a system approach based on the causal behavior between grinding disturbances and the resulting workpiece roundness error is required to effectively address the workpiece out-of-roundness problem.

Accordingly, it is an object of the present invention to provide a novel system approach to minimize the workpiece roundness error in a centerless grinding system (lobing loop system) in which the resulting lobing response to the grinding disturbances is minimized.

It is also an object to provide such a method in which proper grinding and regulating wheels may be readily selected for the centerless grinding process based on the desired centerless grinding performance.

Yet another object is to provide such a method in which the workpiece roundness error is minimized by selecting the proper setup angles $\alpha$ and $\beta$ based upon the grinding disturbances occurring during grinding.

A further object is to provide such a method in which the workpiece roundness error is further minimized by regulating the ratio of the grinding wheel rotational speed to the workpiece rotational speed during the grinding operation.

Still another object is to provide a novel apparatus for practicing the novel method of controlling workpiece roundness error.

SUMMARY OF THE INVENTION

It has now been found that the foregoing and related objects may be readily attained in a method for minimizing the roundness error in a workpiece having a generally circular periphery during centerless grinding of the workpiece in a grinding machine having a bed mounting a grinding wheel and two angularly spaced workpiece supports. During grinding, the workpiece is rotatably supported on the upper surface of the first workpiece support between the grinding wheel and the second workpiece support, and the first support rotatably supports the workpiece in contact with the grinding wheel and the second support. An $\alpha$-setup angle is defined by a first imaginary line extending through the axis of the grinding wheel and the workpiece and a second imaginary line extending through the axis of the workpiece and the point of contact with the first support. A $\beta$-setup angle is defined by the first line and a third imaginary line extending across the axis of the workpiece and the point of contact with the second support. The α-setup angle and β-setup angle cooperate with a cutting ratio to define the transfer function of a lobing loop system in the complex s-plane, and the lobing stability of the lobing loop system is thereby determined.

The workpiece is rotated against the rotating grinding surface of the grinding wheel and the magnitude and frequency of grinding disturbances causing surface waves in the workpiece are detected and determined.

The β-setup angle is modified to minimize the workpiece roundness error by minimizing the response of the lobing loop system under the grinding disturbances. The ratio of the rotational speed of the grinding wheel to the rotational speed of the workpiece is adjusted to further minimize the workpiece roundness error by generating only precessing waves.

Preferably, the lobing stability of the lobing loop system is determined from the characteristic equation of the transfer function of the lobing loop system. The complex s-plane characteristic equation is transformed to the complex u-plane so that the frequency and the growth rate of the surface waves of the lobing loop system are independent of the workpiece rotational speed. Next, the distribution of the characteristic roots of the characteristic equation representing the lobing loop system in terms of the frequency and the growth rate of the surface waves of the lobing loop system are determined.

Generally, the modification of the β-setup angle including combining the distribution of the characteristic roots and the grinding disturbances to determine the response of the lobing loop system. Next, the preferable wave frequencies of the distribution of the characteristic roots having relatively low growth rates are determined based upon the β setup angle. The β setup angle is then adjusted so that the preferable wave frequencies are at or near the frequencies of the grinding disturbances, and the distribution of the characteristic roots of the characteristic equation are determined in terms of the frequency and the growth rate of the surface waves of the lobing loop system. This distribution of characteristic roots is combined with the grinding disturbances to determine the response of the lobing loop system, which in turn is compared with the response determined earlier. The process of determining the β setup is repeated until the response is minimized.

Desirably, the determination of the distribution of the characteristic roots includes determining the upper and lower boundaries of the growth rate of the distribution of the characteristic roots using a Bidiagrammatical Method based upon the geometrical relationship between diagrams representing the regenerative cutting mechanism and the geometric rounding mechanism in the complex u-plane. The characteristic roots may be determined by approximating the nonlinear terms of the characteristic equation using a Taylor series expansion.

Alternatively, the characteristic roots may be determined numerically.

Preferably, the rotational speed ratio may be adjusted to further minimize the workpiece roundness error by determining the magnitude of the transfer function of the lobing loop system over a frequency range using harmonic analysis. Next, the magnitude of the transfer function is combined with the grinding disturbances to determine the response of the lobing loop system including the magnitude, frequency and phase of the dominant waves in the response. The rotational speed ratio corresponding to the frequency of the grinding disturbance resulting from grinding wheel imbalance is then determined and adjusted to shift the phase of the grinding disturbance to generate precessing waves which cancel the dominant waves and further minimize the workpiece roundness error. The speed ratio may be continuously adjusted to shift the phase of the grinding disturbance within a span of one-half a wavelength of the frequency of the lowest of the dominant waves.

Generally, the first workpiece support is a blade support, and the second workpiece support is a regulating wheel. The β-setup angle may be adjusted by adjusting the distance of the blade support from an imaginary line extending between the axis of the grinding wheel and the axis of the regulating wheel.

Preferably, a nominal surface wave growth rate is determined on the basis of a desired centerless grinding performance, a cutting ratio corresponding to the nominal growth rate is determined, and a grinding wheel and a regulating wheel are selected which correspond to the cutting ratio.

Desirably, the cutting ratio may be determined by determining the amount of stock to be removed from the workpiece, rotating the workpiece against the grinding surface of the grinding wheel as it rotates, determining the actual amount of stock removed from the workpiece, and determining the cutting ratio based upon the amount stock to be removed and the actual amount of stock removed. The process may be repeated until the actual cutting ratio corresponds to the selected nominal growth rate.

The preferred apparatus for this centerless grinding includes a bed, a grinding wheel rotatably mounted on the bed, a regulating wheel mounted on the bed spaced from the periphery of the grinding wheel to permit the workpiece to be disposed therebetween, and a support blade mounted on the bed intermediate between the grinding wheel and the regulating wheel. The workpiece is rotatably supported on the upper surface of the support blade and in contact with the grinding wheel and the regulating wheel. As a result, when a workpiece is supported thereon, a workpiece center height is defined by the perpendicular distance of the axis of the workpiece from a first imaginary line extending between the axis of the grinding wheel and the axis of the regulating wheel. A blade top angle is defined by a second imaginary line parallel to the first imaginary line and passing through the point of contact between the workpiece and the support blade and a third imaginary line tangent to the upper surface of the blade.

There is also provided means for determining the lobing stability of a lobing loop system having a complex s-plane transfer function, this transfer function being defined by the blade top angle, the workpiece center height, and a cutting ratio.

There is also provided means for rotating the workpiece against the grinding surface of the grinding wheel as it rotates, and means for detecting and determining the magnitude and frequency of grinding disturbances causing surface waves in the workpiece.

Also included is means for adjusting the workpiece center height to minimize the workpiece roundness error by minimizing the response of the lobing loop system under the grinding disturbances. There is provided means for adjusting the ratio of the rotational speed of the grinding wheel to the rotational speed of the workpiece to further minimize the workpiece roundness error by generating only precessing waves. The means for adjusting the workpiece center height generally includes means for moving the support blade to vary the workpiece center height.

The means for detecting and determining the magnitude and frequency of the grinding disturbances preferably includes a digital signal processor for determining the magnitude and frequency of the grinding disturbances.

In one embodiment, the blade top angle is approximately 0°, and the bed is tilted between 15° and 45° from a level position.

Preferably, the grinding wheel is mounted on the bed in a stationary position, and the regulating wheel is mounted for movement to vary the center to center spacing therebetween.

BRIEF DESCRIPTION OF THE DRAWINGS

FIG. 14 is a diagrammatic illustration of the bidiagrammatic method showing marginally stable roots;

FIG. 30(*b*) a diagrammatical illustration of a precessing wave in a workpiece.

DETAILED DESCRIPTION OF THE PREFERRED EMBODIMENT

The essence of the system approach to minimize the workpiece roundness error according to the present invention is to set up a centerless grinding system (lobing loop system) so that the resulting lobing response (workpiece roundness error) is kept to a minimum under the grinding disturbances which occur. Since the lobing loop system is characterized by the machine setup (K,α,β), the methodologies of selecting a proper set of lobing parameters (K,α,β) form the core of the proposed system approach to lobing suppression. Three methods of lobing suppression are presented herein:

1. Nominal Growth-Rate Method
   A method of selecting proper grinding and regulating wheels for the grinding process based on the cutting ratio K.
2. Pole-Arrangement Method
   A method of selecting the proper setup angles α and β based on the grinding disturbances occurring during grinding.
3. Speed Ratio Regulation Method
   A method of minimizing the workpiece surface wariness by regulating the speed ratio of the grinding wheel rotational speed to the workpiece rotational speed during the grinding operation.

In centerless grinding practice, lobing suppression strategies can be designed by utilizing one or more of the proposed lobing suppression methods depending on the application. To take the full advantage of the proposed system approach to lobing suppression, the three lobing suppression methods should be used sequentially in setting up and/or optimizing a centerless grinding operation.

Figure 1:
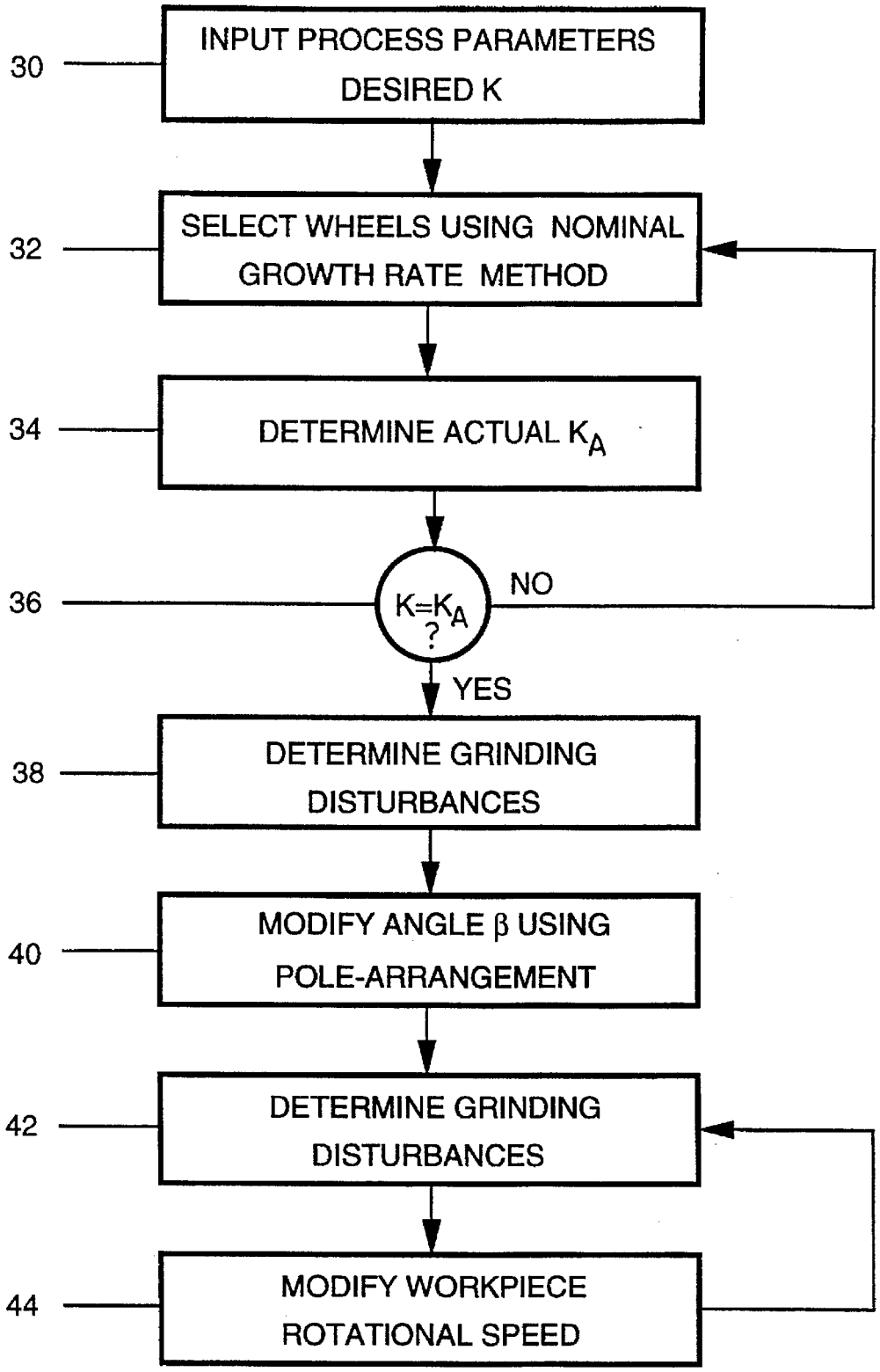
FIG. 1 is a diagrammatic illustration of the steps in a centerless grinding process embodying the present invention.

Turning first to FIG. 1, therein diagrammatically illustrated are the several steps of the process for systematically suppressing the generation of surface waves in a workpiece during centerless grinding. Utilization of these methods essentially provides an expert system for setting up and optimizing a centerless grinding process.

According to the present invention, the centerless grinding procedure may proceed as follows. During the initial step 30, process information, which may include grinding process requirements, wheel/workpiece data, self-excited machine vibration frequencies, initial workpiece surface imperfection, etc., is inputted by the operator into the computer. Based on the given process information, a desired cutting ratio K is determined. Grinding and regulating wheels are selected to achieve the desired cutting ratio in step 32 using the Nominal Growth Rate Method.

Sample workpieces are then centerless ground, and the actual cutting ratio $K_A$ is determined in step 34. Once it is determined in step 36 that the actual cutting ratio $K_A$ is sufficiently equal to the desired K to achieve the desired nominal growth rate, then more workpieces are centerless ground and the grinding disturbances are detected and determined in step 38. Based on the grinding disturbances detected in step 38, the optimal β-setup angle is calculated using the Pole-Arrangement Method and the support blade height is modified accordingly in step 40.

Once the workpiece is being centerless ground using the optimal β-setup angle, any remaining grinding disturbances may be detected in step 42 and the optimum ratio of the grinding wheel rotational speed over the workpiece rotational speed ratio (rotational speed ratio) may be modified in step 44 to further suppress surface wave generation using the Speed Ratio Regulation Method. Steps 42 and 44 may be repeated in a continuous loop and the rotational speed ratio may be adjusted periodically during grinding if necessary.

Figure 2:
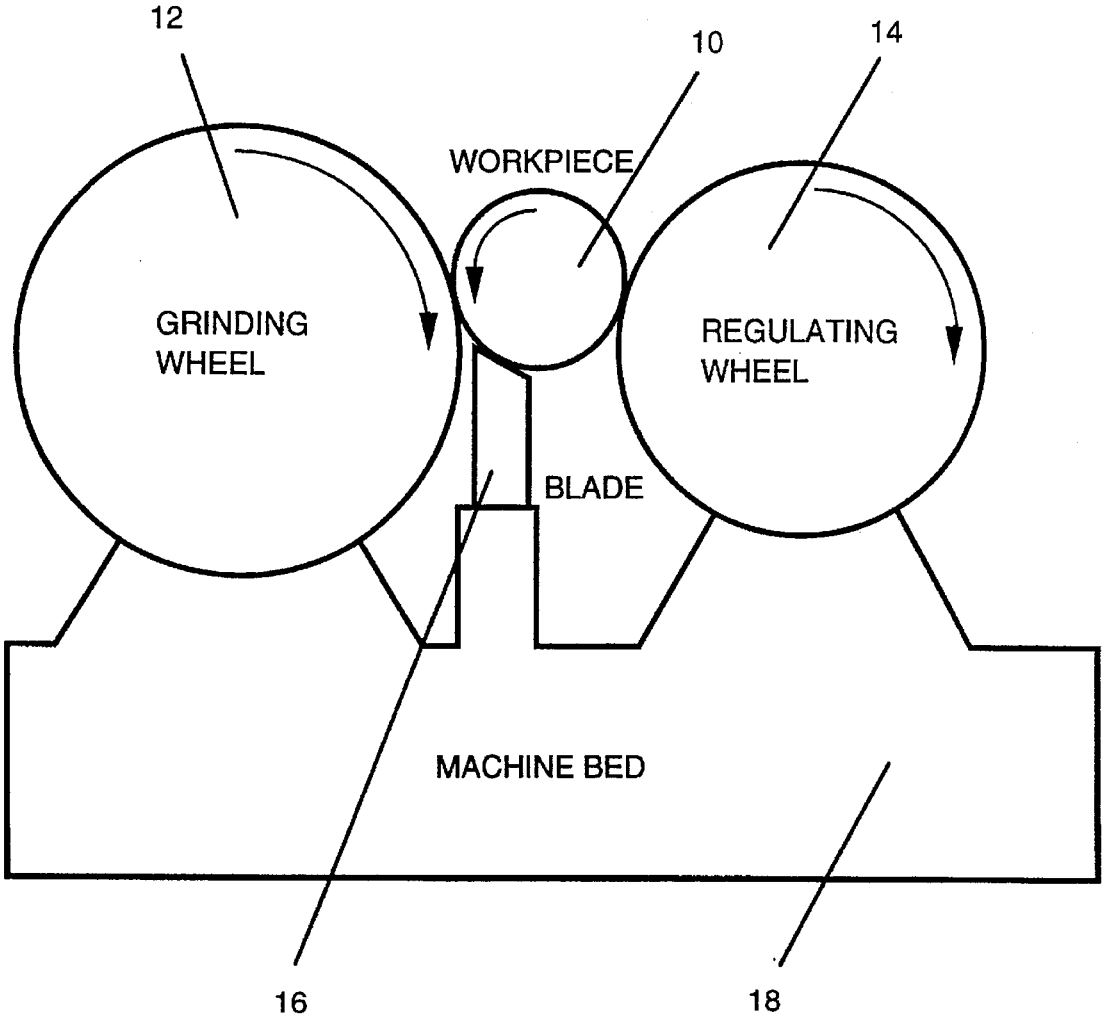
FIG. 2 is a schematic illustration of a centerless grinding apparatus.

Turning next to FIG. 2, therein illustrated is a conventional plunge centerless grinding system which includes a workpiece 10 having a generally circular periphery which is disposed between a grinding wheel 12, a regulating wheel 14, and a support blade 16.

Figure 3A:
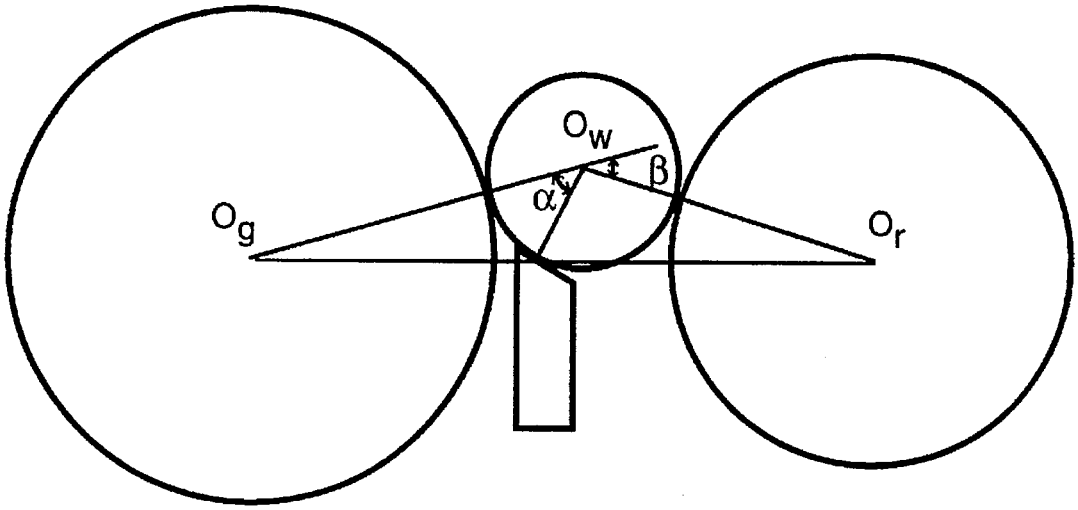
FIGS. 3(*a*) and 3(*b*) are diagrammatic illustrations of the angular relationships in the apparatus of FIG. 2.
Figure 3B:
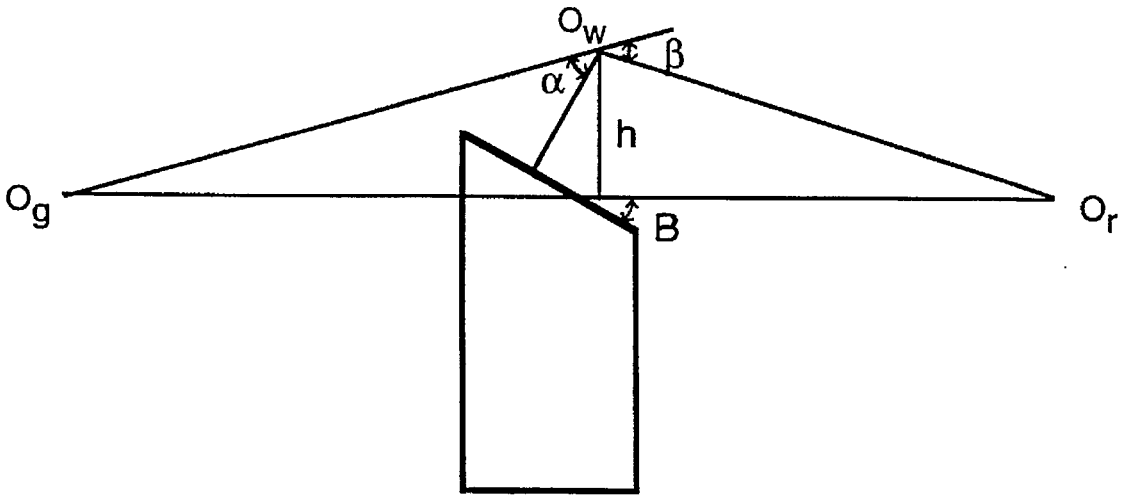

FIG. 3(*a*) illustrates a typical workpiece setup in which the setup angles α and β are used to describe the contact positions between the workpiece and the grinding wheel, regulating wheel, support blade. The setup angles may also be defined in terms of the workpiece center height h and the top angle B of the support blade as shown in FIG. 2(*b*) by the following relationships:

$$\alpha = 90° - B - \arcsin\frac{h}{R_G + R_W} \tag{1}$$

$$\beta = \arcsin\left[\frac{h}{R_G + R_W}\sqrt{1-\left[\frac{h}{R_R + R_W}\right]^2} + \frac{h}{R_R + R_W}\sqrt{1-\left[\frac{h}{R_G + R_W}\right]^2}\right] \tag{2}$$

Where $R_G$=Grinding Wheel Radius;

$R_W$=Workpiece Radius; and $R_R$=Regulating Wheel Radius.

Figure 4:
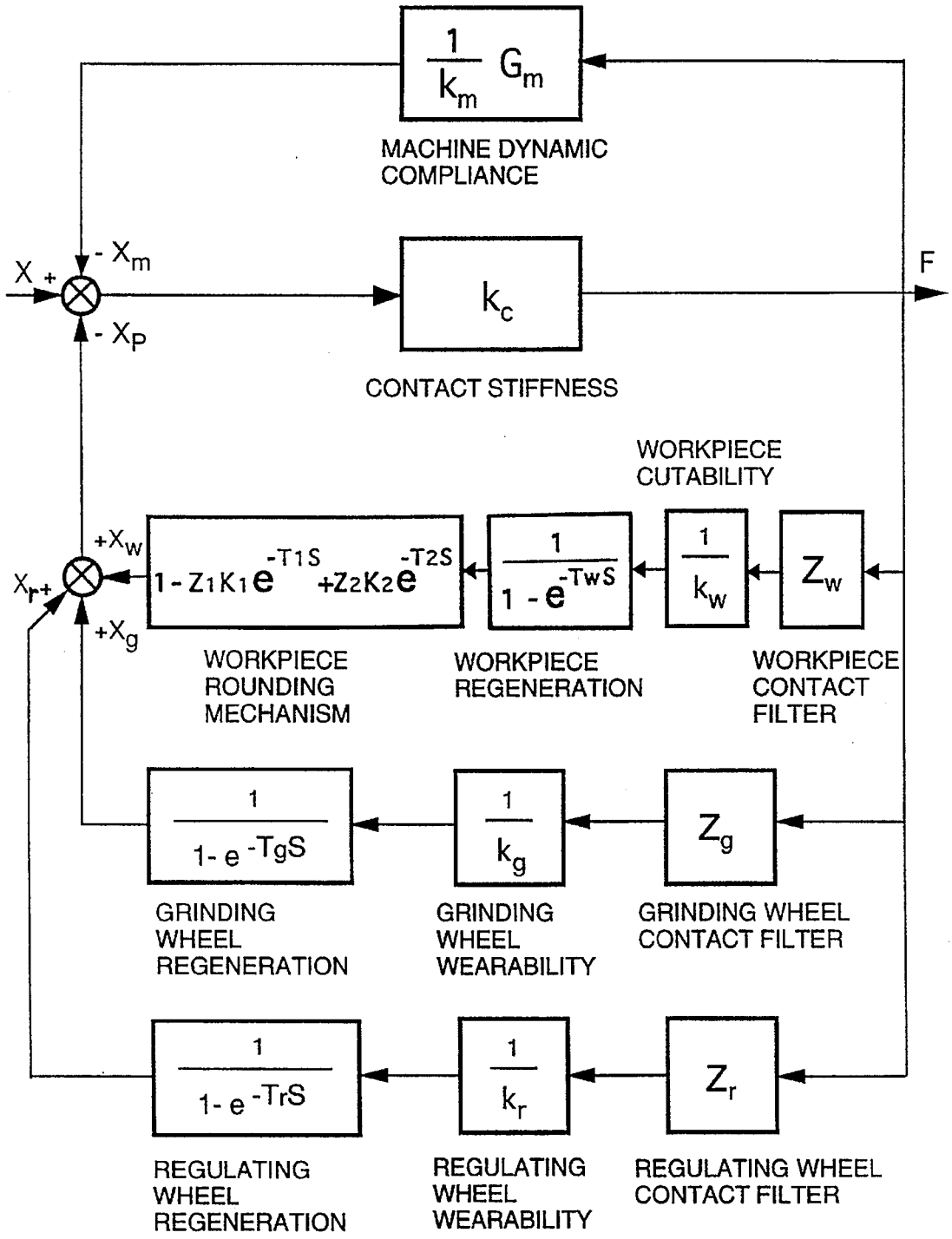
FIG. 4 is a block diagrammatic illustration of the dynamic system mathematical model used in the present invention.

FIG. 4 illustrates a block diagram representation of a centerless grinding process. In this model, various grinding disturbances are summarized as an infeed disturbance x which is considered to be the source causing the workpiece surface wariness. During centerless grinding, the infeed disturbance causes a small variation of the grinding gap between the grinding wheel and regulating wheel. This gap variation results in a corresponding grinding force variation f. In response to the grinding force variation, variations of the workpiece stock removal, grinding wheel wear, regulating wheel wear, elastic structural deformation of the grinding machines, and contact deformations of the wheel/workpiece contact zones are generated. These variations introduce adverse regenerative effects to the grinding process and cause workpiece surface waviness. A unique feature of the centerless grinding process is that the workpiece is not held at a fixed rotational axis during grinding. This feature is reflected in the model by incorporating the effect of the centerless workpiece setup, namely the rounding mechanism, into the workpiece regenerative feedback loop.

Figure 5:
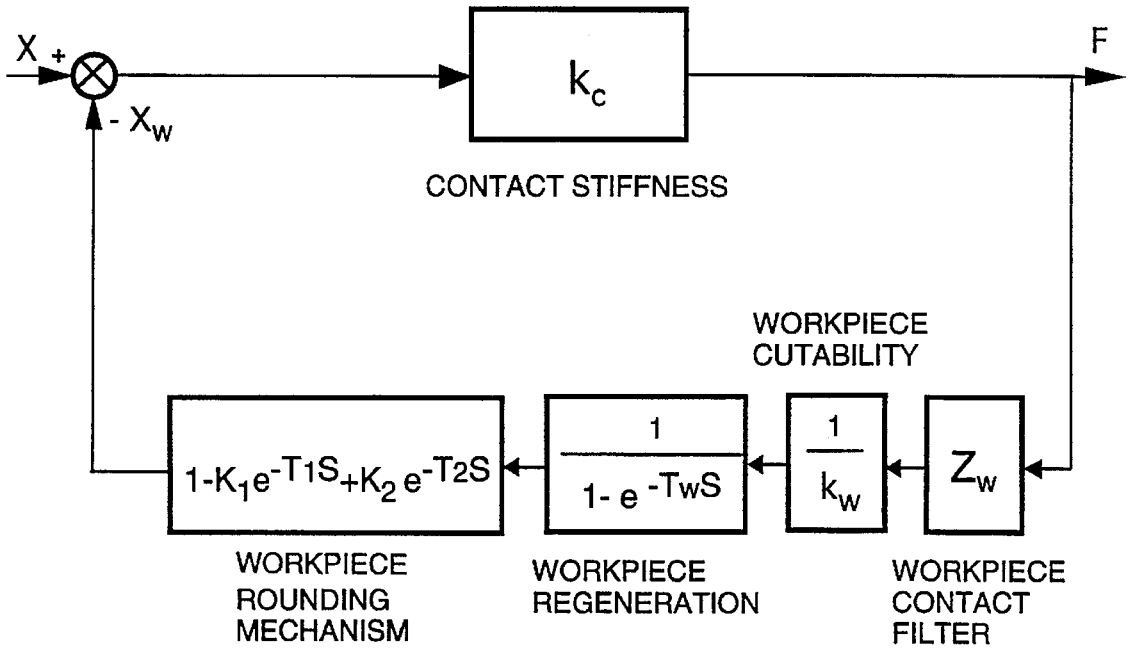
FIG. 5 is a block diagrammatic illustration of the lobing loop mathematical model.

Recognizing the complexity of a centerless grinding process, it is essential to focus only on the main factors causing the workpiece surface wariness. Centerless grinding tests and practical experience indicate that the regenerative effects due to the grinding wheel and regulating wheel are generally negligible. This can be explained by the fact that both wheels used in centerless grinding are of large size, with low wearability, and dressed regularly. A simplified model, called a chatter loop (not shown), can be formulated by assuming that the regenerative effects of the grinding wheel and regulating wheel are negligible. If the effect of self-excited machine vibrations is also negligible, the chatter loop can be further simplified by neglecting the dynamic compliance of the grinding machine as well. As illustrated in FIG. 5, this resulting model, called a lobing loop, is used for the lobing analysis. The surface waves caused by lobing behavior in centerless grinding are described as lobes.

Figure 6:
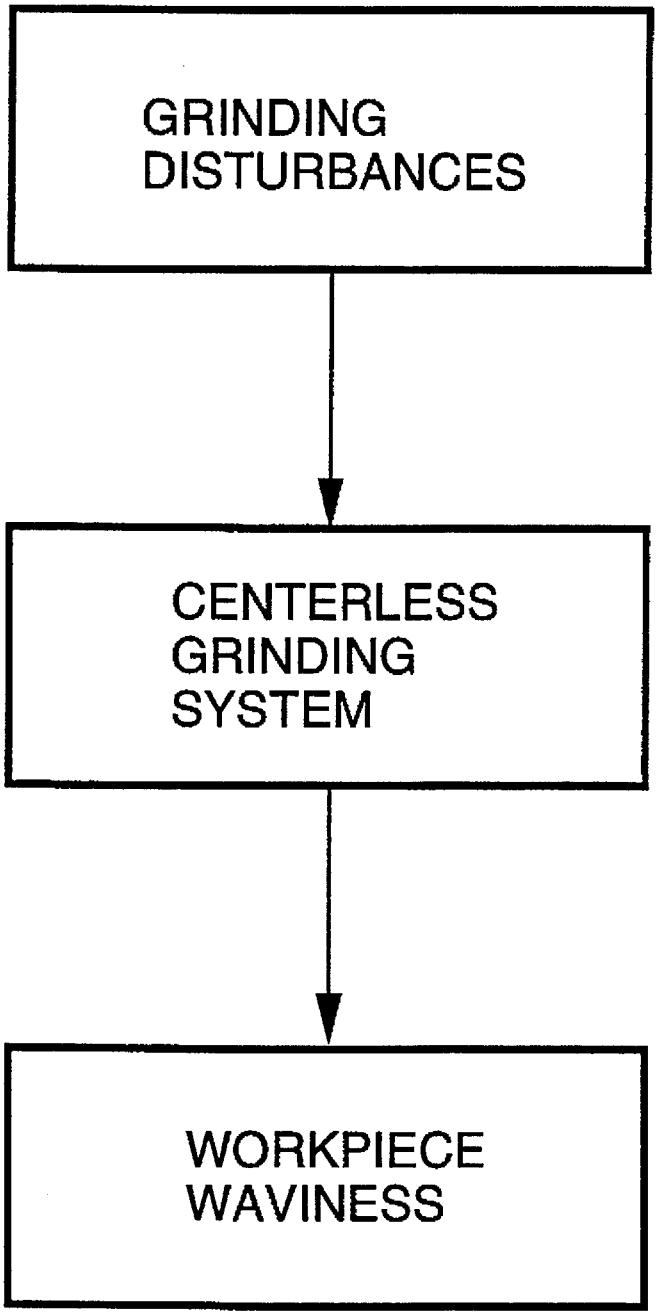
FIG. 6 is a diagrammatic illustration of the causal behavior between grinding disturbances and workpiece waviness.

The focus of centerless grinding research has been concentrated on analyzing the centerless grinding system in the past, and little attention has been paid to the grinding disturbances which are the source causing the workpiece surface waves. The nature and severity of workpiece wariness in centerless grinding is determined by the effect of the grinding disturbances combined with that of the grinding system characteristics, as illustrated in FIG. 6. The uniqueness of the approach in this invention is to consider the effects of both grinding disturbances and grinding system characteristics in setting up and optimizing a centerless grinding process.

Grinding disturbances are referred to herein as encompassing any unwanted influences causing workpiece wariness during grinding, including grinding wheel imbalance, initial workpiece surface imperfection, forced machine vibration, etc. The key to control the workpiece wariness in centerless grinding is to set up the centerless grinding process so that minimum amount of surface waves can be generated on the workpiece under the given grinding conditions.

From a system analysis perspective, the workpiece roundness error can be viewed as the response of the centerless grinding system under the excitation of grinding disturbances.

Figure 7:
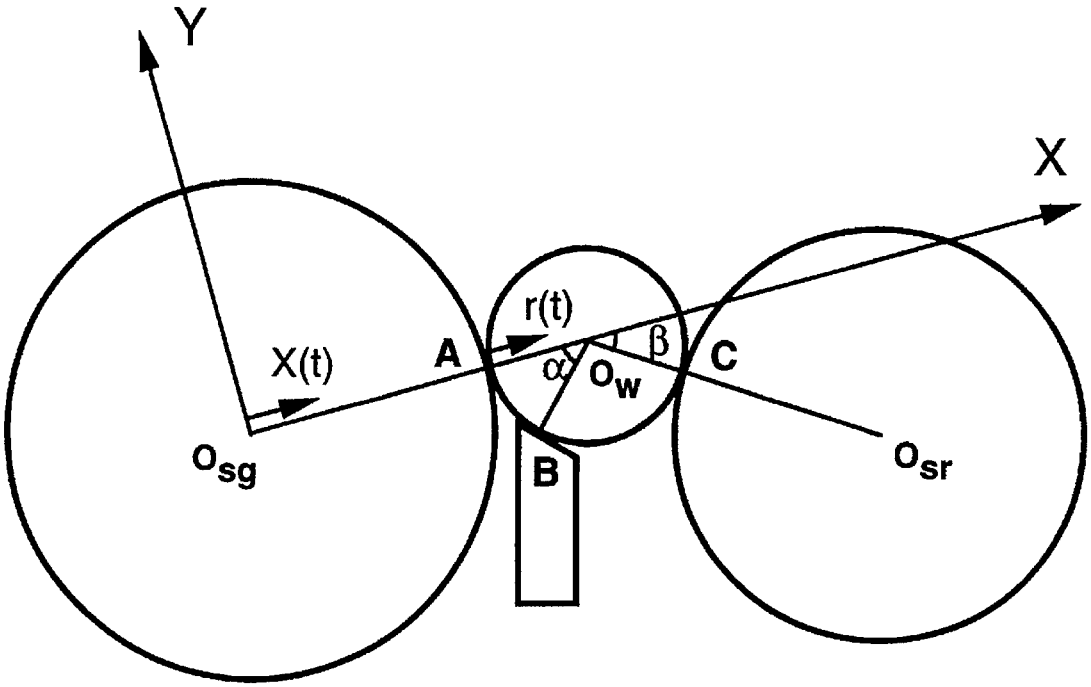
FIG. 7 is a diagrammatic illustration of the characteristics of grinding disturbances.

During centerless grinding the workpiece always maintains a three-point circumferential contact with the workpiece setup, which is formed by the grinding wheel, support blade and regulating wheel (FIG. 7). The contact points between the workpiece and the three constraining elements are noted as A, B and C respectively. Since three noncolinear points define a unique circle, any variation of the workpiece setup or workpiece diameter will result in an instantaneous variation of the workpiece center position, which, in turn, introduces a roundness error to the workpiece surface.

FIG. 7 shows the workpiece in point contact with the grinding wheel, support blade, and regulating wheel at positions A, B, and C respectively. However, in the actual grinding process the workpiece contacts the wheels and the blade with finite lengths of circumferential contact under the influence of the grinding force. As a result of these elastic deformations, a wave pattern generated either in the wheels, or in the workpiece, having a pitch length less than the corresponding contact length is not likely to occur. Thus, the contact areas between the workpiece and the wheels, and between the workpiece and the support blade act as low pass filters, or contact filters, filtering out such short wavelength surface irregularities.

In order to mathematically model the centerless grinding system, a Cartesian coordinate system is defined by choosing the grinding wheel center $O_{zg}$ as the origin of the coordinate system and the center line $O_{zg}O_w$ as the X axis, as shown in FIG. 7. Without losing generality, a grinding disturbance x(t) along the X axis, not including the prescribed steady-state infeed, is used to represent the combined effect of all potential grinding disturbances in the grinding process, where a positive x(t) will result in a reduced instantaneous workpiece radius. An instantaneous workpiece roundness error r(t) is used to represent the instantaneous workpiece surface deviation from the nominal radius at the position A, where a positive r(t) corresponds to a reduced workpiece radius.

During centerless grinding, a grinding disturbance x(t), in addition to the prescribed steady-state infeed, will lead to a corresponding grinding force variation F(t), which is in addition to the steady-state grinding force caused by the prescribed steady-state infeed. In response to the force variation, variations of workpiece depth-of-cut, and grinding and regulating wheel wear occur, and the machine structure vibrates. The main focus of the modeling effort of the present invention is on the causal behavior between the grinding disturbance x(t) and the resulting workpiece roundness error r(t).

This causal behavior in centerless grinding can be mathematically formulated in terms of the following physical relationships. All process variables introduced here are a result of the grinding disturbance x(t), and, therefore, they are only the dynamic components of each respective process parameter; the steady-state components are not included.

As FIG. 7 shows, at any instant of time, the instantaneous workpiece roundness error r(t) must equal the grinding disturbance x(t) minus the contact deformation $\epsilon_c(t)$, geometric rounding feedback of the existing workpiece roundness error $\epsilon_g(t)$, machine dynamic compliance feedback $\epsilon_m(t)$, grinding wheel wear $r_{sg}(t)$, and regulating wheel wear $r_{sr}(t)$:

$$r(t)=x(t)-\epsilon_c(t)-\epsilon_g(t)-\epsilon_m(t)-r_{sg}(t)-r_{sr}(t) \tag{3}$$

The cutting stiffness is a function of the ratio of workpiece speed to wheel-speed $K_v$, and, a linear relationship exists between the cutting stiffness $k_w$ and the speed ratio $K_v$ for commonly used speed ratio values ($K_v$=1/100 . . . 1/20). Thus, it is assumed in this study that the instantaneous variation of workpiece depth-of-cut $\epsilon_w(t)$ is proportional to the grinding force variation F(t).

$$F(t)=k_w\epsilon_w(t)$$

where $k_w$=workpiece cutting stiffness.

Also, the variation of the depth-of-cut $\epsilon_w(t)$ at any instant of time can be expressed as the difference between the instantaneous workpiece roundness error r(t) and that of one workpiece revolution earlier r(t−T).

$$\epsilon_w(t)=r(t)-r(t-T)$$

where T=workpiece rotational period.

Combining the above two equations leads to the following workpiece regenerative cutting equation:

$$F(t)=k_w(r(t)-r(t-T)) \tag{4}$$

The geometric feedback of the workpiece roundness error is a unique feature associated with the floating workpiece center in the centerless grinding.

When the workpiece roundness error r(t) contacts the regulating wheel at position C (see FIG. 7), the workpiece will move accordingly along the inclined surface of the blade. The resulting workpiece center movement $\epsilon_x(t)$ can be represented by a vector diagram seen in FIG. 8(*b*). The displacement component $\epsilon_{gr}(t)$ along the X axis is represented by:

$$\epsilon_{gr}=\frac{\mathrm{Sin}(\alpha)}{\mathrm{Sin}(\alpha+\beta)}\,r(t-T_2)=K_2r(t-T_2)$$

where $T_2$=time delay for workpiece to rotate from A to C.

Figure 8A:
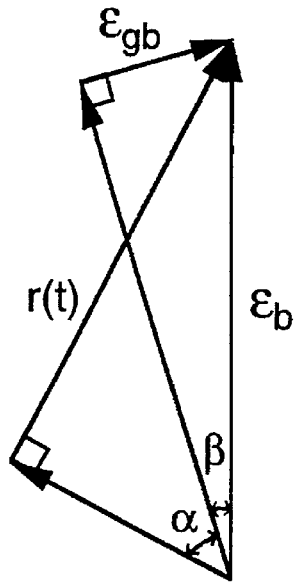
FIGS. 8(*a*) and 8(*b*) are vector diagrams illustrating the geometric regeneration process.
Figure 8B:
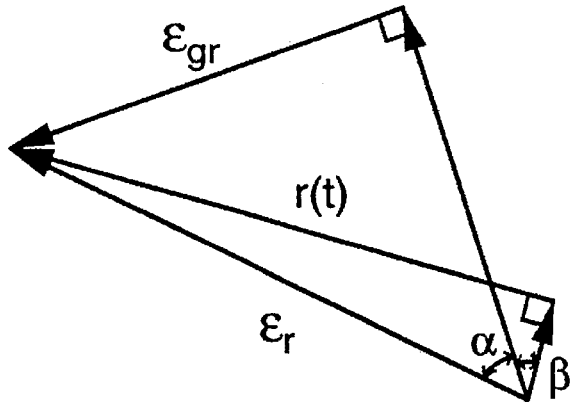

In a similar manner, when the workpiece roundness error r(t) contacts the support blade at the position B and causes the workpiece center to move $\epsilon_b(t)$ along the tangent at B (FIG. 8(*a*)), the center displacement component along the X axis $\epsilon_{gb}(t)$ is represented by:

$$\epsilon_{gb}=-\frac{\mathrm{Sin}(\beta)}{\mathrm{Sin}(\alpha+\beta)}\,r(t-T_1)=-K_1r(t-T_1)$$

where $T_1$=time delay for workpiece to rotate from A to B.

The geometric roundness feedback from the workpiece setup is the summation of the above two geometric feedbacks:

$$\epsilon_g(t)=-K_1r(t-T_1)+K_2r(t-T_2) \tag{5}$$

It is assumed that the instantaneous contact deformation $\epsilon_c(t)$ formed between the grinding wheel axis and the regulating wheel axis, is proportional to the grinding force variation F(t).

$$F(t)=k_{eq}\epsilon_c(t) \tag{6}$$

Figure 9:
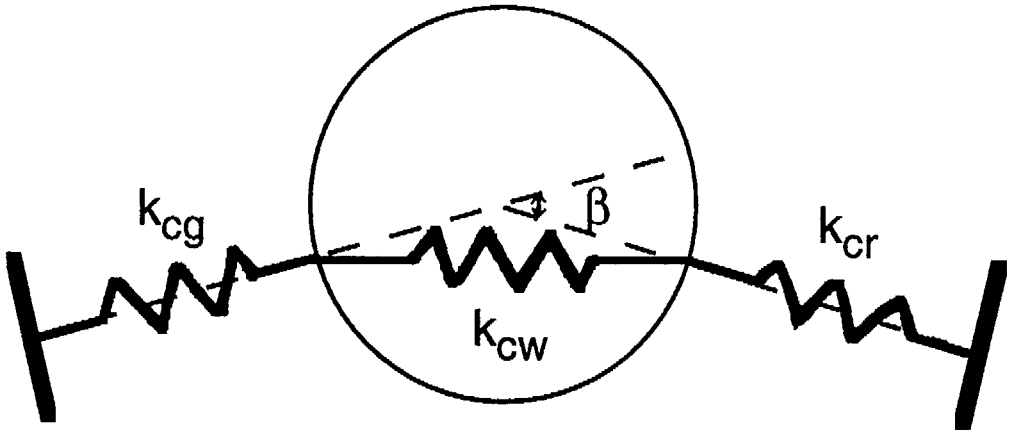
FIG. 9 is a diagrammatic illustration of the equivalent contact stiffness.

The equivalent contact stiffness $k_{eq}$ is introduced here to represent the combined effect of the spring elements formed between the grinding wheel axis and regulating wheel axis (FIG. 9). Since the setup angle β is relatively small (typically less than 15°), $k_{eq}$ can be approximately calculated by $$K=\frac{K_w}{K_{eg}}$$

$$\frac{1}{k_{eg}}=\frac{1}{k_{cg}}+\frac{1}{k_{cw}}+\frac{1}{k_{cr}} \tag{7}$$

where $k_w$=workpiece cutting stiffness $k_{cg}$=grinding wheel/workpiece contact stiffness;

$k_{cr}$=regulating wheel/workpiece contact stiffness;

$k_{cw}$=workpiece diametric contact stiffness;

K=cutting ratio.

For the sake of simplicity, the workpiece diametric deformation is assumed to act like a pure spring, with no mass and damping involved. This assumption is partially justified because the resonant frequencies of workpieces are often significantly higher than the frequencies of grinding disturbances.

Since the actual cutting ratio is most often not known to any reasonable degree, it may be determined empirically in accordance with the following equation:

$$K=\frac{X-X_a}{X_a} \tag{8}$$

where

K=the cutting ratio;

X=the amount of stock to be removed from the workpiece;

$X_a$=the amount of stock actually removed from the workpiece.

The first step in empirically determining the cutting ratio K involves an initial determination of the amount of stock to be removed X from a sample workpiece according to a given set of process parameters. Next, the sample is centerless ground and measured to determine the actual stock removed from the workpiece $X_a$, and the actual cutting ratio K may then be determined.

The centerless grinding system can be evaluated in the Laplace domain from the corresponding Laplace transform equivalents. As follows are the process governing equations presented in the Laplace domain.

Constraint Equation $$R(s)=X(s)-\epsilon_c(s)-\epsilon_g(s)-\epsilon_m(s)-R_{sg}(s)-R_{sr}(s) \quad (9)$$

Workpiece Regenerative Cutting $$\frac{R}{F}(s)=\frac{1}{k_w(1-e^{-sT})} \quad (10)$$

Geometric Roundness Feedback $$\epsilon_g(s)=(-K_1e^{-sT1}+K_2e^{-sT2})\,R(s) \quad (11)$$

Contact Deformation $$F(s)=k_{eq}\epsilon_c(s) \quad (12)$$

Chatter refers to the cases in centerless grinding where the effect of machine vibration on workpiece roundness is significant. If the effect of machine vibration on workpiece roundness error is negligible, the constraint equation (Equation 9) may be simplified to result in the following constraint equation:

$$R(s)=X(s)-\epsilon_c(s)-\epsilon_g(s) \quad (13)$$

Figure 10:
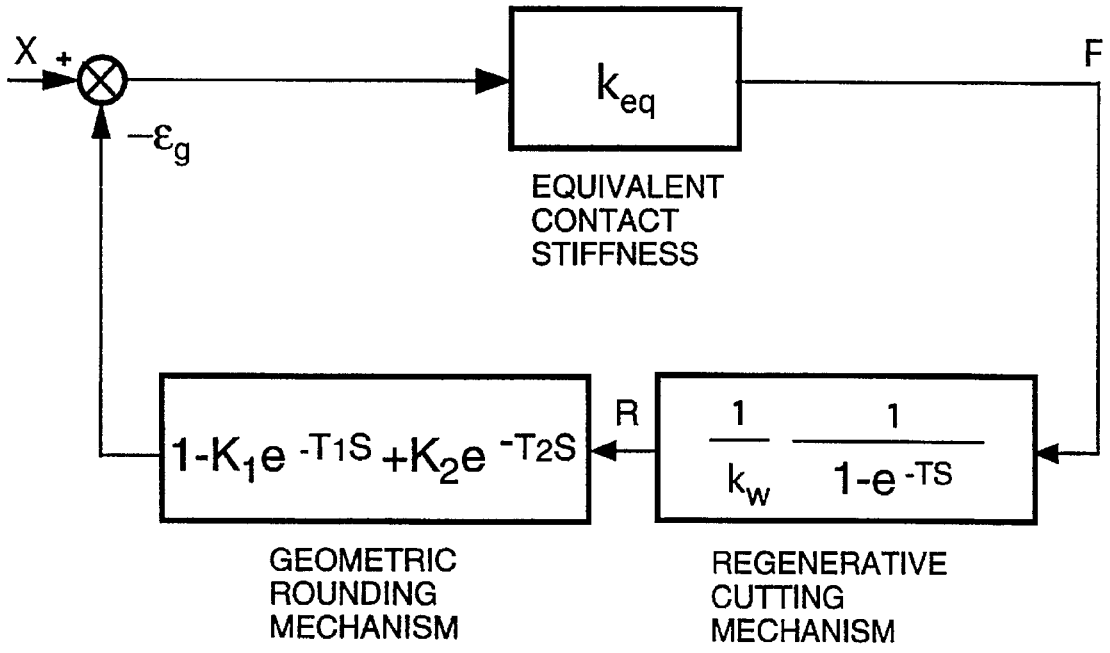
FIG. 10 is a block diagrammatic description of the lobing loop mathematical model.

This system model is called a lobing loop, and the corresponding block diagram is shown in FIG. 10. The lobing loop gives no consideration to the dynamic inertia contributions, and, therefore, can be regarded as a kinematic model.

As FIG. 10 shows, the block diagram of the lobing loop consists of three functional blocks representing the equivalent contact stiffness, workpiece regenerative cutting, and geometric rounding mechanism respectively. The causal behavior between the grinding disturbance X(s) and the workpiece roundness error R(s) can be described by the following transfer function:

$$\frac{R}{X}(s)=\frac{1}{K(1-e^{-sT})+1-K_1e^{-sT1}+K_2e^{-sT2}} \quad (14)$$

Because of the geometric rounding mechanism, the lobing loop can be unstable without the influence of machine structural vibration in centerless grinding. This unique feature is called "lobing instability" which refers to the stability of a lobing system (e.g., lobing loop); while the term "geometric stability" refers to the stability of the geometric rounding mechanism only.

Among the kinematic performance qualities of the lobing system, lobing stability is an important system characteristic. A lobing system is stable if the lobing response caused by a transient grinding disturbance, approaches zero as time approaches infinity; otherwise it is not stable.

Lobing stability can be ascertained from the characteristic equation of the lobing loop. By setting the denominator of the lobing loop transfer function (Equation 14) equal to zero, the characteristic equation is obtained as:

$$K(1-e^{-sT})+(1-K_1e^{-sT1}+K_2e^{-sT2})=0 \quad (15)$$

Generally, the characteristic roots of the characteristic equation are complex and have the following form in the complex s-plane:

$$s_i=\sigma_i+j\omega_i \qquad j=\sqrt{-1}$$

where i=1,2,3, . . .

The imaginary portion $\omega_i$ represents the angular velocity of the lobing response associated with that particular characteristic root; the real portion $\sigma_i$ is the growth rate, which represents the rate of growth, or decay, of the lobing response associated with that root.

The stability characteristics of the lobing loop are determined by the locations of the characteristic roots in the complex s-plane. If all of the characteristic roots lie in the left half of the s-plane, the real portions of the roots are all negative ($\sigma_i<0$) and the system is said to have lobing stability. If one of the characteristic roots lies in the right half of the s-plane, the real portion of that root is positive ($\sigma_i>0$). In this case the general solution of the system equation will have a positive exponential contribution that yields an exponentially increasing and unstable lobing response. It is obvious that a similar unstable behavior will result in the case of multiple roots located in the right half of the s-plane. If there are characteristic roots that lie on the imaginary axis ($\sigma_i=0$), and all remaining roots lie in the left half of the s-plane, the lobing system is considered to be marginally stable. In this case, any original workpiece roundness error that corresponds to these pure imaginary roots, will neither increase nor decrease with increased grinding time. The growth rate (real portion) $\sigma_i$ can be utilized not only for the assessment of absolute lobing stability, but also for the evaluation of the degree of lobing stability associated with the respective roots. Therefore, this is regarded as relative lobing stability.

The overall system response of the lobing loop is the sum of all individual responses associated with the respective characteristic roots. Since the characteristic equation (Equation 15) contains transcendental terms, there is an infinite number of characteristic roots that will satisfy it. Thus, the overall lobing response, as characterized by the workpiece roundness error R(s) in Equation 14, can be expressed as the sum of an infinite number of individual responses as obtained from an infinite number of characteristic roots. This evaluation can be conveniently accomplished in either the Laplace or temporal domain respectively as $$R(s)=\sum_{i=1}^{\infty}\frac{C_i}{(s-s_i)} \quad (16)$$

$$r(t)=\sum_{i=1}^{\infty}C_ie^{s_it}$$

Figure 16:
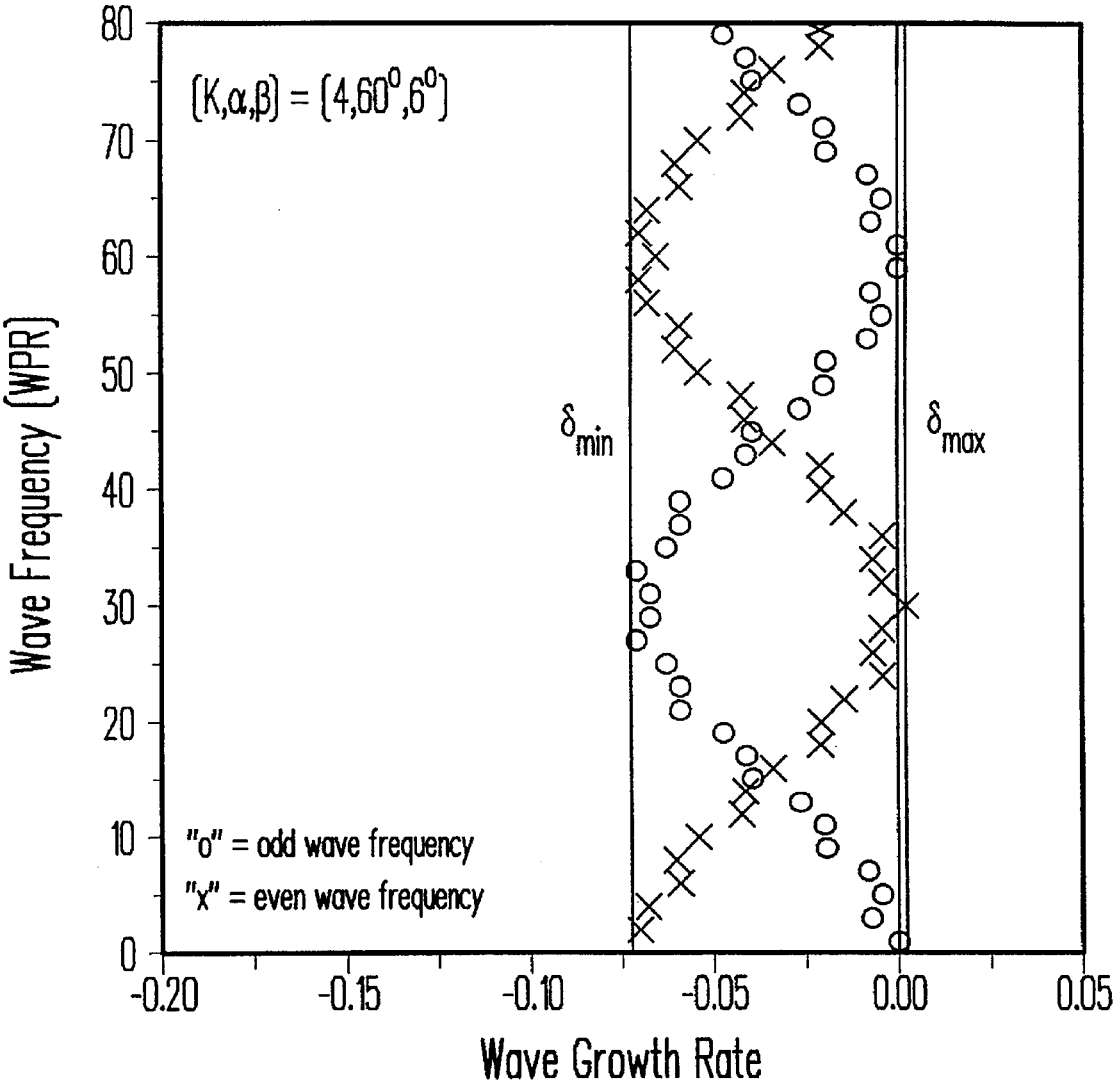
FIG. 16 is a graph of the characteristic root distribution of the lobing loop system.

From a viewpoint of system analysis, the workpiece out-of-roundness (R) due to lobing can be viewed as the response of the lobing system—lobing response—caused by the grinding disturbances, as shown in FIG. 16. Depending on the frequency characteristics of the grinding disturbances, the lobing response may or may not increase with time even though the lobing system is unstable in terms of absolute lobing stability. If one or more unstable characteristic roots are excited by the grinding disturbances during the grinding process, the lobing response will increase with time, and significant workpiece out-of-roundness can be anticipated at the lobing frequencies associated with those unstable roots. On the other hand, if no unstable roots are excited, the lobing response will attenuate to a steady-state level, and the magnitude of the steady-state response depends on the relative lobing stability at the lobing frequencies associated with the grinding disturbances. The steady-state lobing response refers to that portion of the lobing response that has fixed response behavior as time approaches infinity.

It is not convenient to conduct lobing analysis in the complex s-plane, because the growth rate $\sigma$ in the s-plane varies with the workpiece rotational speed. To overcome this difficulty, a coordinate transformation is designed to transform the lobing loop from the s-plane to a new complex u-plane. This coordinate transformation is given by $$u=\frac{T}{2\pi}\,s \tag{17}$$

where $u=\delta+jn$

In the u-plane, the imaginary portion n is called a wave frequency representing the number of Waves Per (workpiece) Revolution (WPR); the real portion $\delta$ is called a wave growth rate representing the rate of surface wave growth, or decay, per workpiece revolution. The conversion between the s-plane and the u-plane is given by $$\delta=\frac{T}{2\pi}\,\sigma\ \&\ n=\frac{T}{2\pi}\,\omega \tag{18}$$

The above coordinate transformation leads to $$St=2\pi u \tag{19}$$

Also, from the geometrical description of the centerless grinding process it can be shown that $$\frac{T_1}{\alpha}=\frac{T_2}{\pi-\beta}=\frac{T}{2\pi}$$

which leads to $$St_1=\alpha u\ \&\ St_2=(\pi-\beta)u \tag{20}$$

Combining Equations 14, 19 and 20, the lobing loop transfer function in the u-plane becomes $$\frac{R}{X}(u)=\frac{1}{K(1-e^{-2\pi u})+(1-K_1e^{-\alpha u}+K_2e^{-(\pi-\beta)u})} \tag{21}$$

the characteristic equation is given by $$K(1-e^{-2\pi u})+(1-K_1e^{-\alpha u}+K_2e^{-(\pi-\beta)u})=0 \tag{22}$$

Accordingly, the characteristic roots of Equation 22 can be written as $$u_i=\delta_i+jn_i \qquad j=\sqrt{-1}$$

where i=1,2,3, . . .

The above transformation of the lobing loop from the complex s-plane to the complex u-plane enables the lobing loop to be presented in terms of the wave frequency (n) and wave growth rate ($\delta$), instead of the angular velocity ($\omega$) and growth rate ($\sigma$). The advantage of assessing lobing stability in the u-plane is that the wave frequency and wave growth rate are independent of the workpiece rotational speed. Therefore, prior knowledge of the workpiece rotational speed is not necessary for lobing analysis in the u-plane.

For computer simulation of lobing responses in the temporal domain, the governing equation is obtained from the inverse Laplace transformation of Equation 21

$$r(\theta)=\frac{1}{1+K}\,(x(\theta)+Kr(\theta-2\pi)+K_1r(\theta-\alpha)-K_2r(\theta-\pi+\beta)) \tag{23}$$

Since Equation 23 is fully defined in the angular domain, the lobing loop after the coordinate transformation can be represented by the parameters K, $\alpha$ and $\beta$ only. This set of process parameters ($K,\alpha,\beta$) is called a machine setup.

From a system analysis viewpoint, the workpiece surface roundness error R caused by lobing behavior in centerless grinding can be viewed as the response of a lobing system (lobing response) excited by various grinding process disturbances (grinding disturbances). In order to effectively control the workpiece roundness error, both the lobing system and grinding disturbances have to be considered in the grinding process. To this purpose, a full knowledge of the characteristic roots are needed for lobing control.

One approach for the assessment of lobing stability is to numerically compute the characteristic roots of the lobing loop. The main limitation of this method is that a significant amount of computation time is required because of the necessity to address a large number of roots of the infinite set associated with the transcendental form of the characteristic equation. The roots must be computed one at a time and convergence of the numerical computation process to a specific root is not guaranteed unless the initial guess is sufficiently close to the desired root location.

The Bidiagrammatic Method estimates the fractional portions of the characteristic roots based on the geometrical relationship between the cutting diagram and rounding diagram in the u-plane.

The purpose of numerically solving the characteristic roots is to evaluate the accuracy of the estimated boundaries of the fractional portions obtained through the Bidiagrammatic Method. The uniqueness of the computational present approach is that it numerically calculates the characteristic roots only within the respective root neighborhoods provided through the Bidiagrammatical Method. Therefore, it has improved accuracy and requires less computational time.

The characteristic equation of the lobing loop (Equation 22) can be alternatively rewritten as $$-K(1-e^{-2u\pi})=1-K_1e^{-u\alpha}+K_2e^{-u(\pi-\beta)} \tag{24}$$

where the left side represents the regenerative cutting mechanism of the grinding process, and the right side represents the geometric rounding mechanism. Thus, lobing can be viewed as a result of the interaction between the regenerative cutting mechanism and the geometric rounding mechanism as illustrated by FIG. 10.

The essence of the Bidiagrammatical Method is to estimate lobing stability by utilizing two separate diagrams, namely cutting and rounding diagrams, which independently represent the regenerative cutting mechanism and the geometric rounding mechanism.

In developing the Bidiagrammatic Method, it is necessary to develop a vector representation of the characteristic equation (Equation 24). Vectors $\vec{V}_K$, $\vec{V}_1$ and $\vec{V}_2$ are introduced to represent the transcendental terms in Equation 24 as follows:

$$\vec{V}_K = Ke^{-2\pi u} Ke^{-2\pi\delta} e^{-j2\pi n}$$

$$\vec{V}_1 = -K_1 e^{-\alpha u} = K_1 e^{-\alpha\delta} e^{j(\pi-\alpha n)}$$

$$\vec{V}_2 = K_2 e^{-(\pi-\beta)u} = K_2 e^{-(\pi-\beta)\delta} e^{-j(\pi-\beta)n}$$

For any given value of wave growth rate $\delta$, the vectors $\vec{V}_k$, $\vec{V}_1$ and $\vec{V}_2$ are rotational vectors in the u-plane, which exhibit circular trajectories with respective radii of $Ke^{-2\pi\delta}$, $K_1e^{-\alpha\delta}$ and $K_2e^{-(\pi-\beta)\delta}$ for $0<n<\infty$.

Accordingly, vectors $\vec{V}_C$ and $\vec{V}_R$ are introduced to represent the regenerative cutting mechanism and the geometric rounding mechanism respectively. They can be expressed in terms of the vectors $\vec{V}_k$, $\vec{V}_1$ and $\vec{V}_2$ in the u-plane as follows:

$$\vec{V}_C = Ke^{j\pi} + \vec{V}_K$$

$$\vec{V}_R = e^{j0} + \vec{V}_1 + \vec{V}_2$$

Figure 11:
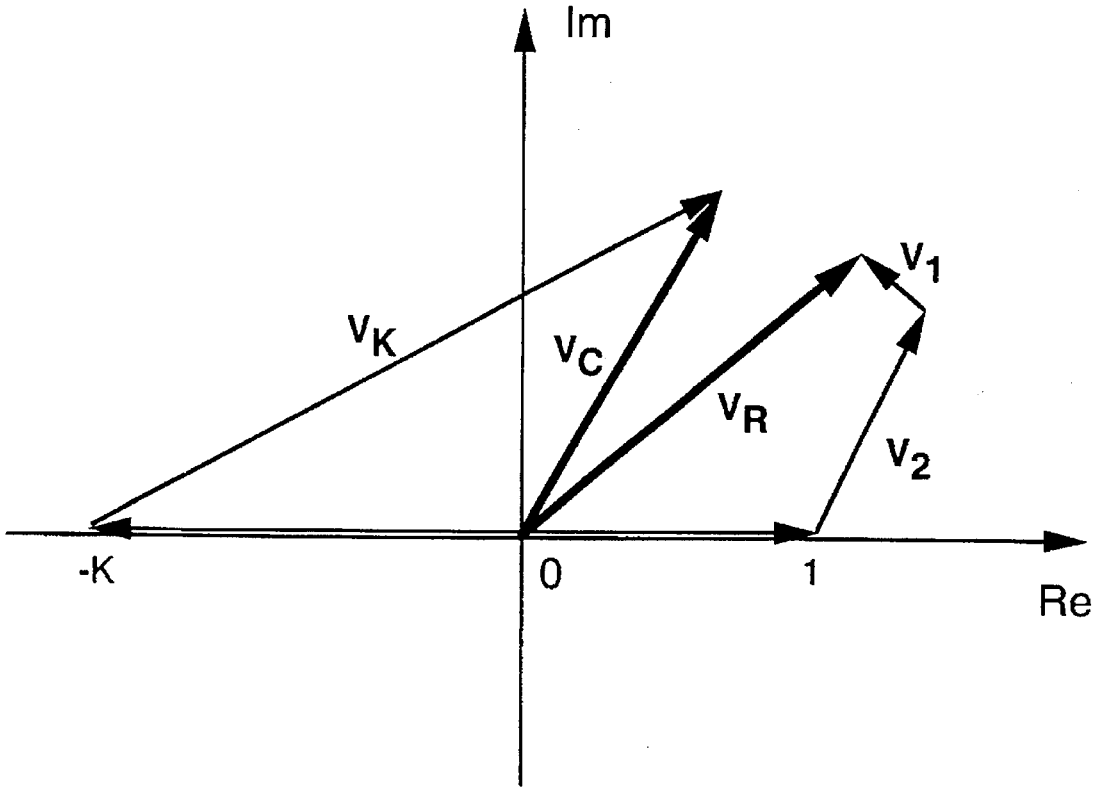
FIG. 11 is a vector diagram of FIG. 10.

When $\vec{V}_C = \vec{V}_R$ (FIG. 11), the corresponding wave growth rate $\delta_i$ and wave frequency $n_i$ form a characteristic root ($u_i = \delta_i + jn_i$). Because the cutting ratio K is greater than 1 for practical centerless grinding, the phase angle of the rectory $\vec{V}_C(-2\pi n)$ must be limited in the close proximity of the zero angle reference $O_CO$ in order to satisfy the vector equality $\vec{V}_C = \vec{V}_R$. Knowing the zero angle reference corresponds to only integer wave frequencies, the wave frequencies of the characteristic roots can be expressed as the sum of integer portion wave frequencies $N_i$ and fractional portion wave frequencies $\eta_i$ ($-0.5<\eta_i\leqq 0.5$):

$$n_i = N_i + \eta_i \tag{25}$$

Accordingly, the characteristic roots can be written in terms of their integer portions and fractional portions:

$$u_i = jN_i + \mu_i = jN_i + (\delta_i + j\eta_i) \tag{26}$$

where $Jn_i$=integer portion of the root $u_i$;

$\mu_i$=fractional portion of the root $u_i$.

Figure 12:
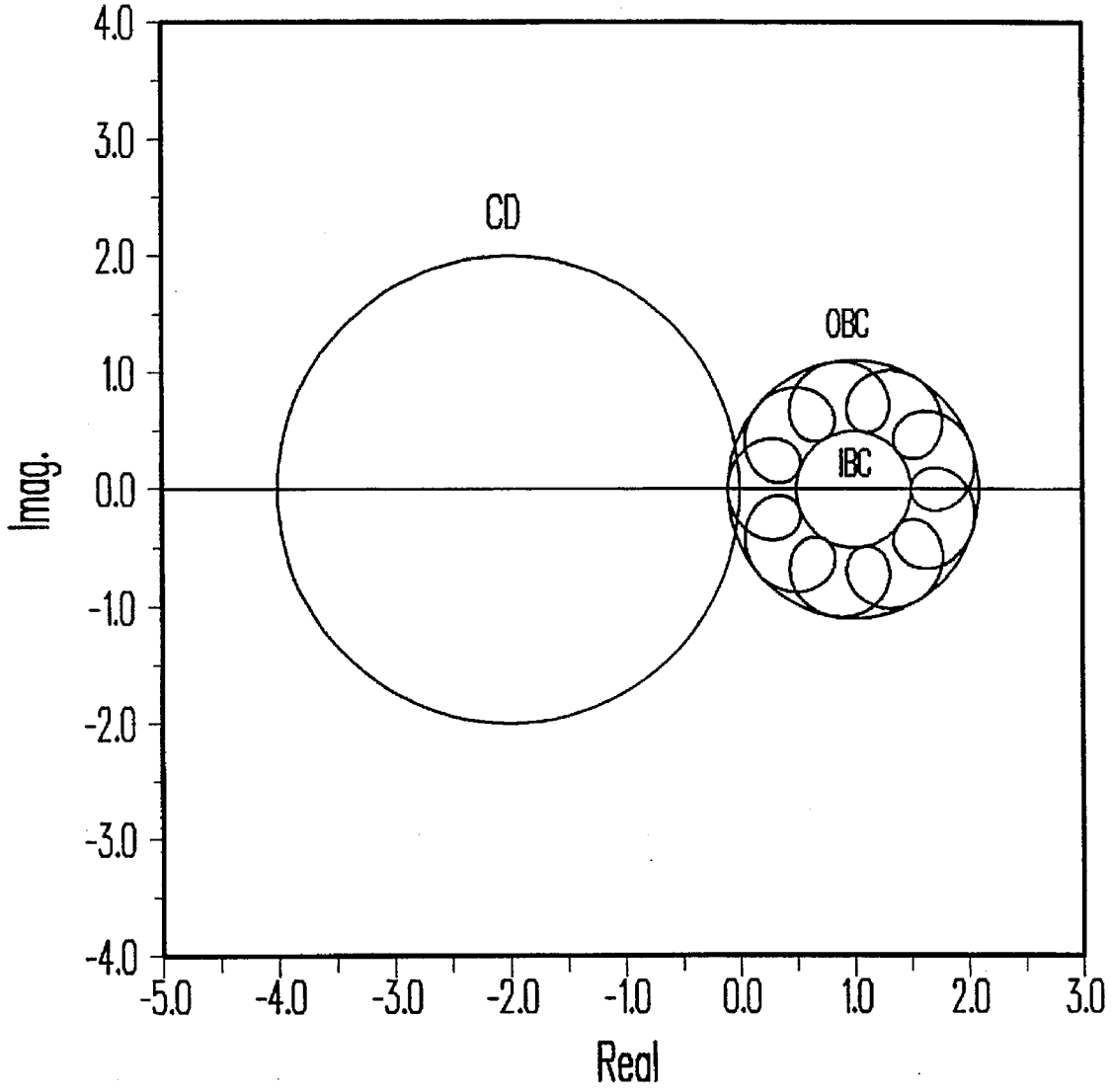
FIG. 12 is a diagrammatic illustration of the cutting diagram and the rounding diagram.

FIG. 12 shows the trajectories of the vectors $\vec{V}_C$ and $\vec{V}_R$, which are referred to as the cutting trajectory and rounding trajectory respectively. Geometrically, the characteristic roots of Equation 24 can be identified as the intersection points between the cutting and rounding trajectories at which $\vec{V}_C = \vec{V}_R$. If, for a given wave growth rate $\delta$, the two trajectories do not intersect in the u-plane, the corresponding lobing loop has no characteristic root of that wave growth rate.

A further examination of the rounding trajectory reveals that the rounding trajectory is inner bounded by an Inner Boundary Circle (IBC) and outer bounded by an Outer Boundary Circle (OBC) (FIG. 12), both are centered at (1,0) and with respective radii of:

$$R_I = K_2e^{-(\pi-\beta)\delta} - K_1e^{-\alpha\delta}$$

$$R_O = K_2e^{-(\pi-\beta)\delta} + K_1e^{-\alpha\delta}$$

The simple geometry of these boundary circles leads to the following diagrammatical presentation of Equation 24.

Figure 13:
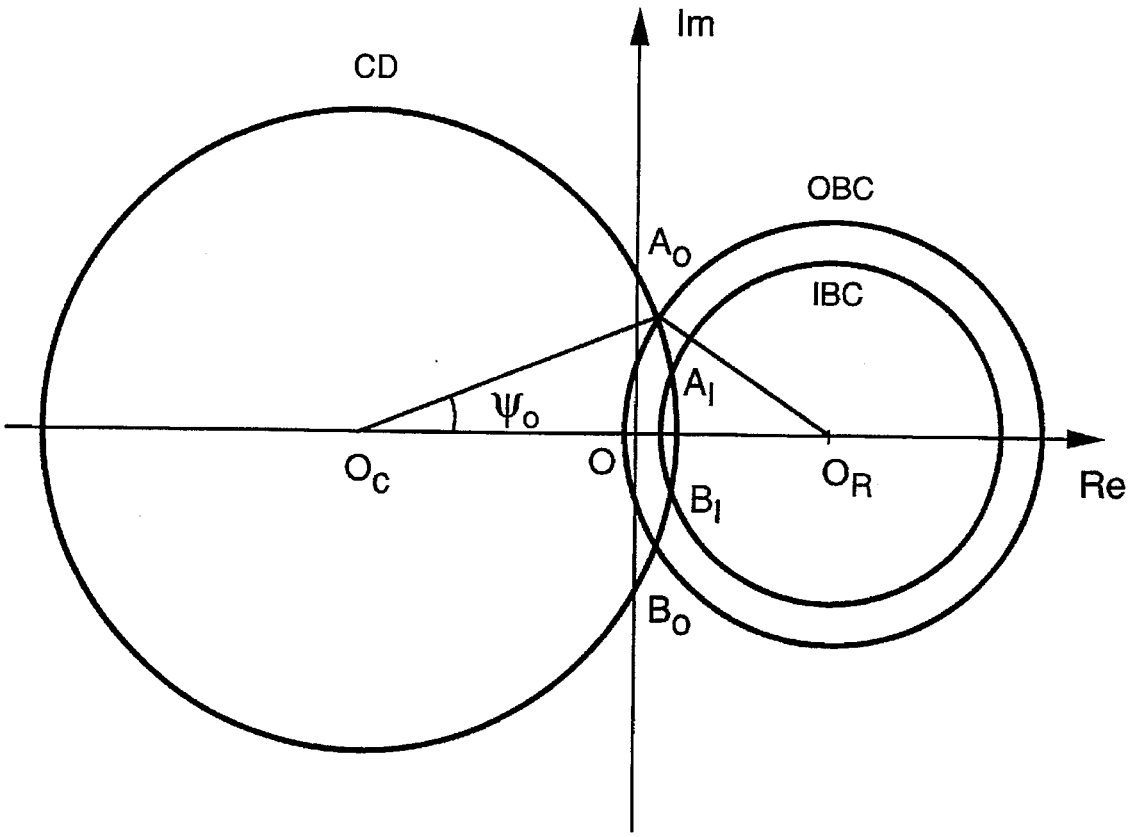
FIG. 13 is a diagrammatic illustration of the bidiagrammatical method.
Figure 15A:
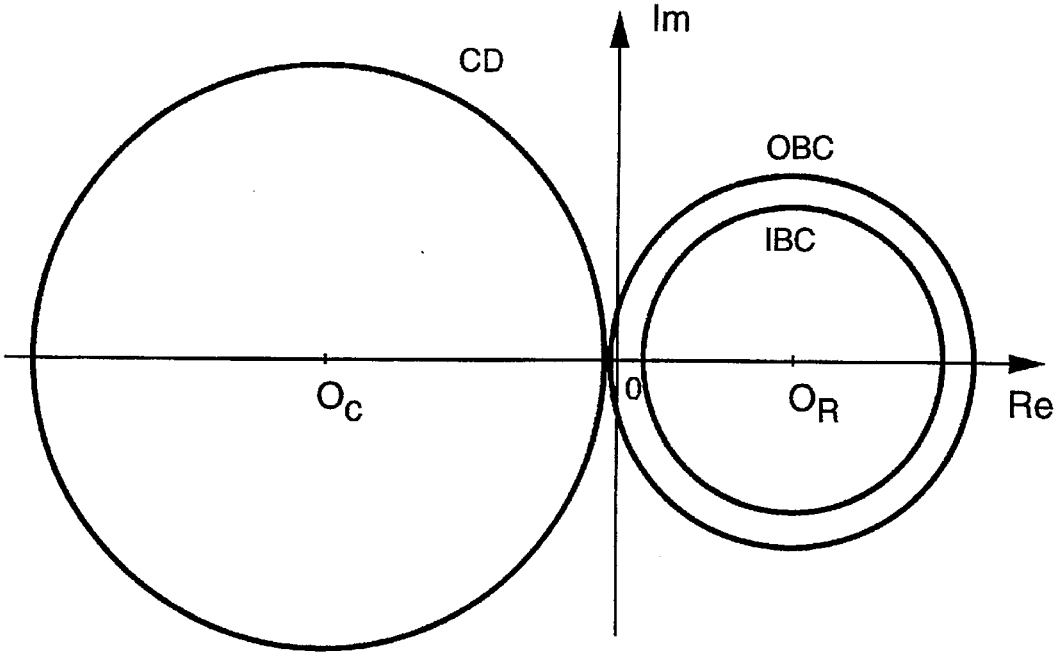
FIGS. 15(*a*) and 15(*b*) are diagrammatic illustrations of the Bidiagrammatic Method showing the upper and lower growth rate boundaries.
Figure 15B:
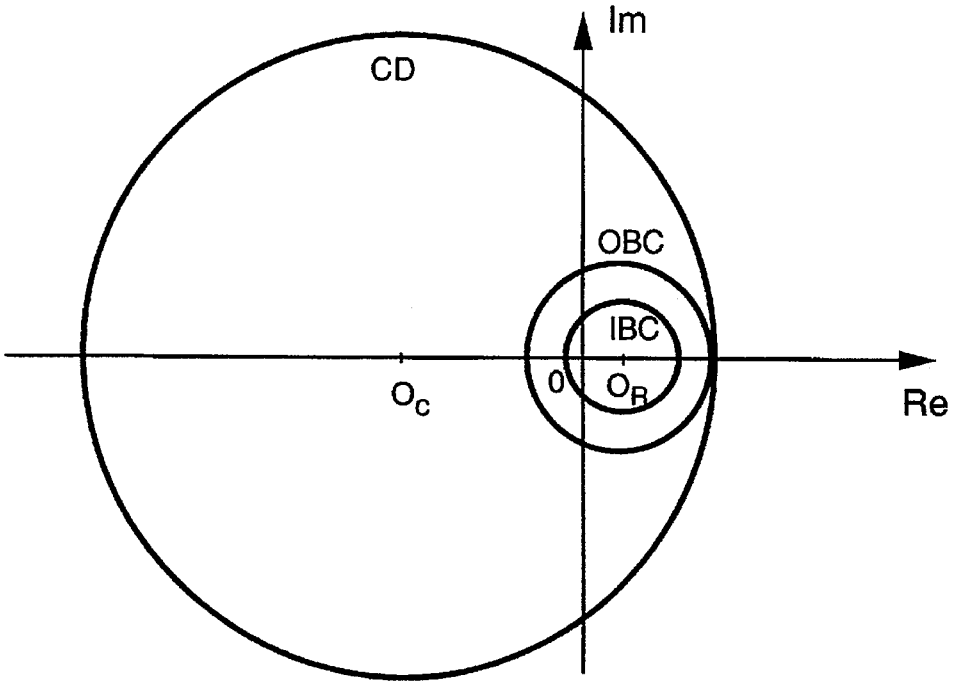

Two diagrams, the cutting Diagram (CD) and the rounding diagram (RD), are introduced to graphically represent the regenerative cutting mechanism and the geometric rounding mechanism respectively. As FIG. 13 shows, RD is constructed by using the boundary circles IBC and OBC of the rounding trajectory, while CD is identical to the cutting trajectory that is centered at (−K,0) and with radius of $Ke^{-2\pi\delta}$. Since the rounding trajectory is bounded between IBC and OBC, the intersections between the cutting trajectory and the rounding trajectory can occur only between IBC and OBC. Thus the characteristic roots of the lobing loop can be obtained only between IBC and OBC.

Further, since the cutting diagram CD is identical to the cutting trajectory, the characteristic roots of a given wave growth rate are all constrained on the corresponding CD. This, together with the fact that the roots are restricted between IBC and OBC, leads to conclude that the characteristic roots of a given wave growth rate can only be obtained on the corresponding arc $A_OA_I$ and $B_IB_O$ (FIG. 13). For simplicity, the arc $A_OB_O$ is used to represent both the arc $A_OA_I$ and $B_IB_O$. Thus, the characteristic roots of a given wave growth rate are restricted on the corresponding arc $A_OB_O$ defined by the cutting diagram CD and rounding diagram RD.

Geometrically, each point on the arc $A_OB_O$ can be characterized by a unique center angle $\Psi$ ($-\pi<\Psi<\pi$). The relationship between the fractional portion wave frequencies $\eta$ and the corresponding center angles $\Psi$ is given by $$\eta = \frac{\Psi}{2\pi}$$

and $\eta$ can be estimated if the boundary values of the center angle $\Psi$ can be identified.

Assuming the cutting diagram CD intersects the outer boundary circle OBC at points $A_o$ and $B_o$ (FIG. 13), the relationship between the center angle $\Psi_o$ associated with the point $A_O$ and the growth rate $\delta$ can be obtained by applying the Law of Cosines to the triangle $A_OO_CO_R$:

$$\mathrm{Cos}(\Psi_o) = \frac{(K+1)^2 + K^2e^{-4\pi\delta} - [K_1e^{-\alpha\delta} + K_2e^{-(\pi-\beta)\delta}]^2}{2K(K+1)e^{-2\pi\delta}} \tag{27}$$

As illustrated in FIG. 13, all center angles $\Psi$ associated with the characteristic roots of a given wave growth rate $\delta$ are bounded by the center angle $\Psi_o$:

$$-\Psi_o \leqq \Psi \leqq \Psi_o$$

The boundary of the center angles associated with all the characteristic roots of Equation 24 can be obtained by setting the first derivative of $\mathrm{Cos}(\Psi_o)$ to zero in Equation 27:

$$\frac{d(\mathrm{Cos}\Psi_o)}{d\delta}\Big|_{\delta=\delta_{lim}} = 0 \tag{28}$$

where $\delta_{lim}$ is the growth rate associated with the center angle boundary $\Psi_{lim}$. $\Psi_{lim}$ is obtained by substituting $\delta_{lim}$ into Equation 27:

$$\Psi_{lim} = \mathrm{Cos}^{-1}\left[\frac{(K+1)^2 + K^2e^{-4\pi\delta_{lim}} - [K_1e^{-\alpha\delta_{lim}} + K_2e^{-(\pi-\beta)\delta_{lim}}]^2}{2K(K+1)e^{-2\pi\delta_{lim}}}\right] \tag{29}$$

Thus, the fractional portion wave frequencies associated with the characteristic roots of Equation 24 are limited in the range of $$-\eta_{lim} \leqq \eta_i \leqq \theta_{lim\ m} \quad (30)$$

where:

$$\eta_{lim} = \frac{\Psi_{lim}}{2\pi} \quad (30)$$

When the characteristic root is marginally stable, the corresponding wave growth rate is equal to zero ($\delta$=0). Thus, the center angle boundary of all marginally stable roots can be obtained by setting $\delta$=0 in Equation 27, which leads to $$\Psi_{mar} = \mathrm{Cos}^{-1}\left[\frac{(K+1)^2 + K^2 - (K_1+K_2)^2}{2K(K+1)}\right] \quad (31)$$

Because the radii of the boundary circles (IBC & OBC) and cutting diagram (CD) decrease with an increasing wave growth rate, for unstable characteristic roots the corresponding radii of IBC, OBC and CD are smaller than their equivalence of the marginally stable roots. Thus, the intersection points between CD and OBC for the unstable roots fall within the shaded area defined by the case of marginally stable roots (FIG. 16). This implies that the center angle boundary of the marginally stable roots ($\Psi_{mar}$) is also the boundary of all center angles associated with the unstable roots. Accordingly, the fractional portion wave frequencies associated with the marginally stable and unstable roots are limited in the following range:

$$-\eta_{mar} \leqq \eta_i \leqq \eta_{mar} \quad (32)$$

where:

$$\eta_{mar} = \frac{\Psi_{mar}}{2\pi} \quad (32)$$

The wave frequencies of the characteristic roots of the lobing loop can be estimated using Equations 30 and 32, along with Equation 25. In general, these wave frequencies are in the close proximity of their respective integer portion wave frequencies.

Knowing that the radii of the boundary circles (IBC & OBC) and cutting diagram (CD) decrease with an increasing wave growth rate $\delta$, the upper growth rate boundary $\delta_{max}$ corresponds to the case where the radii of IBC, OBC and CD are minimum. This extreme case occurs when the cutting diagram CD is tangent to the left side of the outer boundary circle OBC seen in FIG. 17(*a*).

Noting that the center angle $\Psi_o$ is equal to zero for this extreme case, the upper growth rate boundary $\delta_{max}$ can be obtained by setting $\Psi_o$ equal to zero in Equation 27. By doing so, Equation 27 leads to $$Ke^{-2\pi\delta_{max}} + K_1 e^{-\alpha\delta_{max}} + K_2 e^{-(\pi-\beta)\delta_{max}} = K+1 \quad (33)$$

Figure 17:
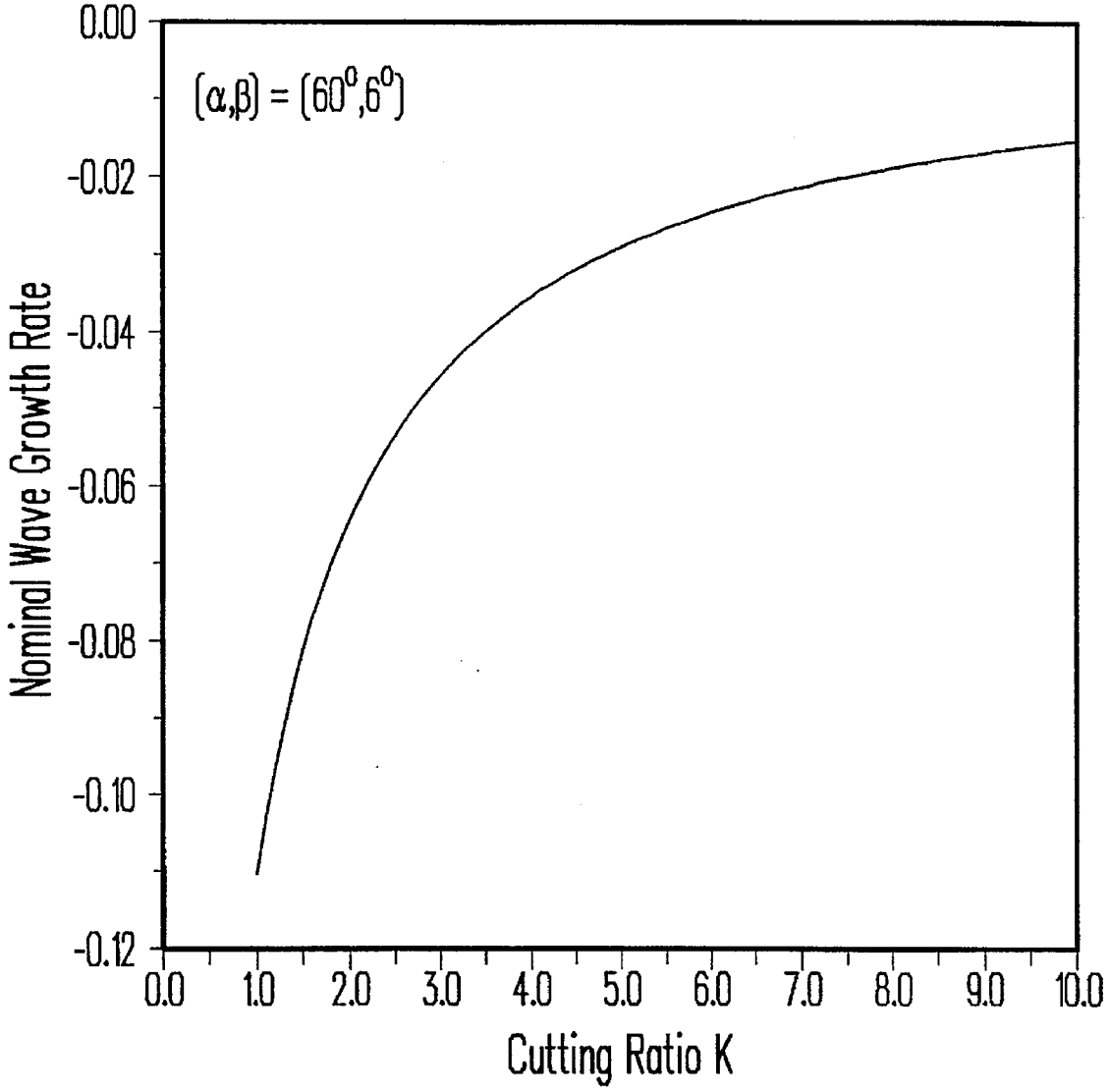
FIG. 17 is a graph of nominal wave growth rate versus cutting ratio.

By applying the same argument, the lower growth rate boundary $\delta_{min}$ can be identified when the cutting diagram CD is tangent to the right side of the outer boundary circle OBC seen in FIG. 17(*b*). This leads to $$Ke^{-2\pi\delta_{min}} - K_1 e^{-\alpha\delta_{min}} - K_2 e^{-(\pi-\beta)\delta_{min}} = K+1 \quad (34)$$

$\delta_{max}$ and $\delta_{min}$ can be solved from the above equations by using standard numerical computation procedures.

Thus, for a given machine setup (K,$\alpha$,$\beta$), the wave growth rates of the characteristic roots are limited in the range of $$\delta_{min} \leqq \delta_{i \leqq \delta max} \quad (35)$$

The upper growth rate boundary $\delta_{max}$ is always greater than but very close to zero, and the lower growth rate boundary $\delta_{min}$ is smaller than zero:

$$\delta_{max} > 0$$

$$\delta_{min} < 0$$

Consequently, the lobing loop is unstable in terms of absolute lobing stability, and the degree of the instability is dependent on the machine setup (K,$\alpha$,$\beta$), Thus, through the Bidiagrammatic Method, the following estimations of the characteristic roots of the lobing loop can be made:

1) The characteristic roots can be expressed as the sum of their integer portions and fractional portions:

$$u_i = jN_i + \mu_i = jN_i + (\delta_i + j\eta_i)$$

2) The fractional portions of the roots are limited in a small neighborhood of [$\delta_{min} \leqq \delta_i \leqq \delta_{max}$, $-\eta_{lim} \leqq \eta_i \leqq \eta_{lim}$]. This neighborhood is called a root neighborhood.

3) The fractional portions of all marginally stable and unstable roots are limited in a small neighborhood of [$0 \leqq \delta_i \leqq \delta_{max}$, $-\eta_{max} \leqq \eta_i \leqq \eta_{max}$]. This neighborhood is called a marginal root neighborhood.

As an illustration of the Bidiagrammatic Method, the following is provided as example using a lobing system with the following machine setup:

$$(K, \alpha, \beta)\ (4, 60°, 6°)$$

The corresponding root neighborhood and marginal root neighborhood are numerically calculated and given as follows:

Root Neighborhood

[$-0.07241 \leqq \delta_i \leqq 0.00223$, $-0.03748 \leqq \eta_i \leqq 0.03748$]

Marginal Root Neighborhood

[$0 \leqq \delta_i \leqq 0.00223$, $-0.01277 \leqq \eta_i \leqq 0.01277$]

FIG. 16 shows a distribution of the characteristic roots in the wave frequency range of 0 through 80 WPR. Clearly, these numerically obtained characteristic roots are bounded between the upper and lower growth rate boundaries. The fractional portions of the roots are limited within the root neighborhood, while the fractional portions of all marginally stable and unstable roots are restricted within the marginal root neighborhood.

In general, the wave growth rate of the characteristic roots bears two periodic components, one caused by the setup angle $\alpha$ and the other caused by the setup angle $\beta$. The periodic components caused by the setup angles $\alpha$ and $\beta$ can be estimated respectively by $$\tau_1 = \frac{360}{\alpha} \ \&\ \tau_2 = \frac{360}{\beta}$$

In centerless grinding practice, the setup angles $\alpha$ and $\beta$ are typically chosen from the following ranges:

$$30° < \alpha < 90°$$

$-15° < \beta < 15°$

For the above given ranges, the wave growth rate variation caused by the setup angle $\alpha$ is significantly smaller than that caused by the setup angle $\beta$. Thus, the effect of the periodic component $\tau_1$ can be considered to be of secondary consideration, and the periodicity of the wave growth rate can be approximated by $$\tau_n = \frac{360}{\beta} \tag{36}$$

where $\tau_n$ is called a nominal growth rate period.

It is also important to note that the wave growth rates associated with odd wave frequencies and those associated with even wave frequencies both vary with the nominal growth rate period $T\tau_n$, but with a $(180/\beta)$ phase shift (FIG. 16). Because of this phase shift, the wave growth rates are relatively low for both odd and even wave frequencies around the following wave frequencies:

$$n_p = \frac{180}{\beta}\left(\text{integer} + \frac{1}{2}\right) \tag{37}$$

These wave frequencies $n_P$ are called preferable wave frequencies. It is desirable to conduct centerless grinding around the preferable wave frequencies.

The concept of mean wave growth rate characterizes the DC offset of the characteristic root distribution (FIG. 16) which is defined as $$\bar{\delta} = \frac{\delta_{min} + \delta_{max}}{2} \tag{38}$$

FIG. 17 shows that the mean wave growth rate increases as the cutting ratio K increases. This indicates that it is favorable to conduct centerless grinding with a lower cutting ratio if a lower mean wave growth rate is desired. However, the value of the cutting ratio can only be reduced moderately, since a lower cutting ratio may result in lobing instability at certain wave frequencies.

Figure 18:
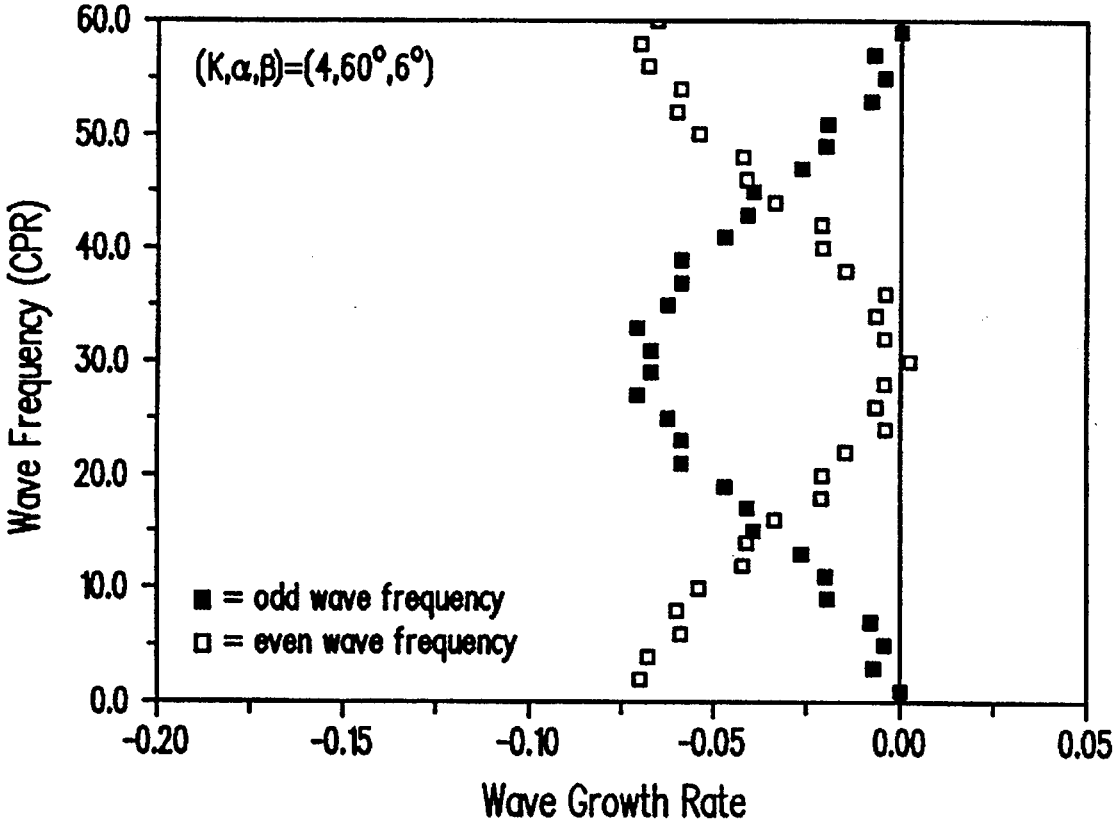
FIG. 18 is a graph of wave frequency versus wave growth rate.

Considering the machine setup (4,60°,6°), the root distribution in FIG. 18 clearly exhibits periodicity over the wave frequency. This root distribution periodicity is governed by the characteristic equation of the lobing loop (Equations 22 and 24) alternatively rewritten as:

$$1 - K_1 e^{-\alpha u} + K_2 e^{-(\pi-\beta)u} + K(1 - e^{-2\pi u}) = 0 \tag{39}$$

from which the following equation with trigonometric coefficients is obtained:

$$K^2\chi^{4\pi} - K_1^2\chi^{2\alpha} + 2K_1(K+1)\mathrm{Cos}(\alpha n)\chi^{\alpha} - 2K_2(K+1)\mathrm{Cos}[(\pi-\beta)n]\chi^{(\pi-\beta)} - K_2\chi^{2(\pi-\beta)} + 2K_1K_2\chi^{(\pi+\alpha-\beta)} - (K+1) = 0 \tag{40}$$

where $\chi = e^{-\delta}$

For a given wave frequency (n), the wave growth rate ($\delta$) can be numerically solved from Equation 40. Since the coefficients of Equation 40 vary periodically with a period equal to the least common multiple of $(2\pi/\alpha)$ and $(2\pi/\beta)$, the obtained wave growth rate will vary accordingly with the same period. Consequently, the root distribution of Equation 40 exhibits the same periodicity over the wave frequency.

As an example, the root distribution period for the machine setup (4,60°,6°) is calculated to be 60 CPR (Cycles Per Revolution). This periodicity is evident in FIG. 18, which also shows the effect of the periodic component $(2\pi/\beta)$ to the overall root distribution is more significant than that of the periodic component $(2\pi/\alpha)$. In fact, this observation is generally true for all setup angles commonly used in industry. From a practical perspective, the setup angle $\beta$ is of primary consideration in lobing analysis and control, while the setup angle $\alpha$ is of secondary consideration.

Since the effect of setup angle $\alpha$ to the root distribution is of secondary importance, it is desirable to simplify the lobing analysis by concentrating only on the setup angle $\beta$. For this purpose, the term $[K_1e^{-\alpha\delta} + K_2e^{-(\pi-\beta)\delta}]e^{-j(\pi-\beta)n}$ is used in lieu of the term $[-K_1e^{-\alpha u} + k_2e^{-(\pi-\beta)u}]$ in Equation 39. This leads to $$1 + K[1 - e^{-2\pi u}] + [K_1e^{-\alpha\delta} + K_2e^{-(\pi-\beta)\delta}]\, e^{-j(\pi-\beta)n} = 0 \tag{41}$$

The root distribution of the modified characteristic equation 41 is called a root distribution envelope, or a root envelope. Since it has been shown that the wave frequencies associated with the characteristic roots are limited within close proximity of the respective integer wave frequencies ($\eta_{lim} << 1$), these wave frequencies can be approximated by their respective integer wave frequencies:

$$n_i \approx N_i$$

Substituting the above approximation into equation Equation 41 leads to the following equations:

For $N_i$=even wave frequency $$K^2\chi^{4\pi} - K_1^2\chi^{2\alpha} + 2K_1(K+1)\mathrm{Cos}(\beta N)\chi^{\alpha} - 2K_2(K+1)\mathrm{Cos}[(\beta N)]\chi^{(\pi-\beta)} - K_2^2\chi^{2\alpha} + 2K_1K_2\chi^{(\pi+\alpha-\beta)} - (K+1) = 0 \tag{40}$$

For $N_i$=odd wave frequency $$K^2\chi^{4\pi} - K_1^2\chi^{2\alpha} + 2K_1(K+1)\mathrm{Cos}(\beta N - \pi)\chi^{\alpha} - 2K_2(K+1)\mathrm{Cos}[(\beta N - \pi)]\chi^{(\pi-\beta)} - K_2^2\chi^{2(\pi-\beta)} + 2K_1K_2\chi^{(\pi+\alpha-\beta)} - (K+1) = 0 \tag{43}$$

Thus, the root envelope is formed by the roots of even wave frequencies as obtained from Equation 42 and the roots of odd wave frequencies from Equation 43. Since the coefficients of Equations 42 and 43 are periodic functions of periodicity $(2\pi/\beta)$, the resulting root envelop will exhibit the same periodicity.

Figure 19:
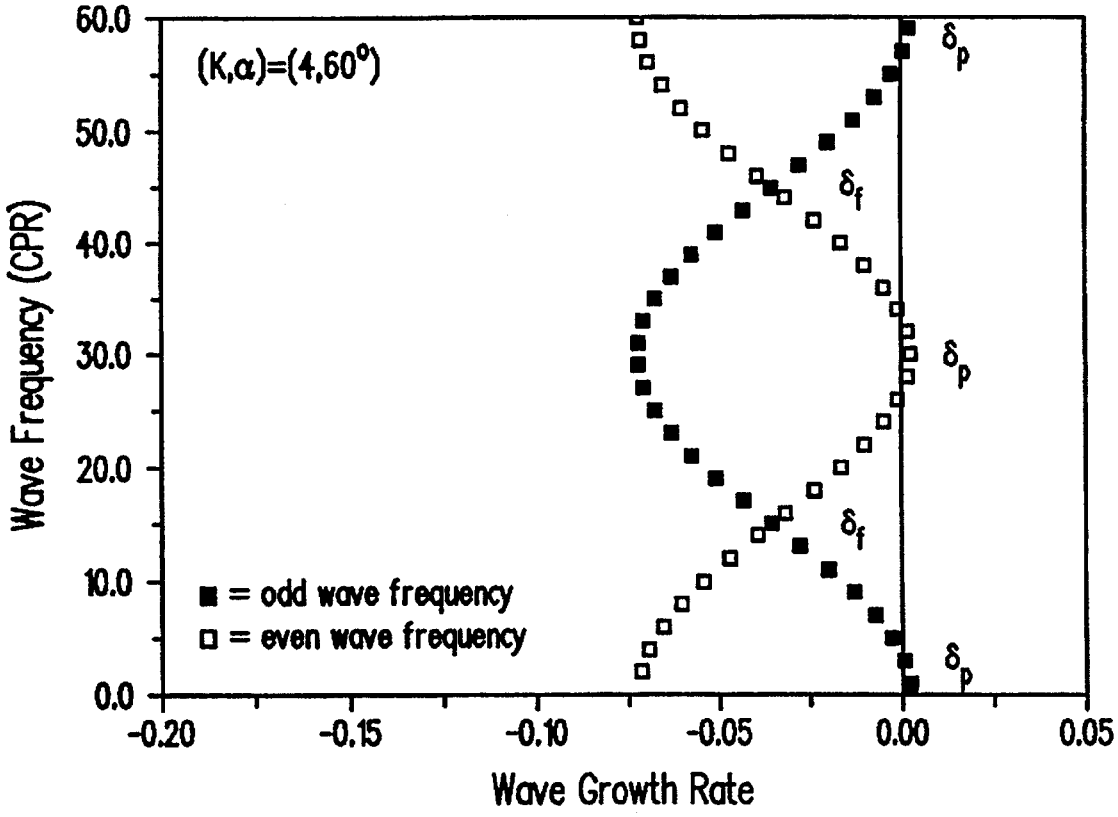
FIG. 19 is a graph of odd and even wave frequencies.

FIG. 19 shows a root distribution envelop for the following process parameters:

$K=4;\ \beta=6°.$

From this figure, the nominal wave growth rate period and mean growth rate can be easily identified.

Figure 20:
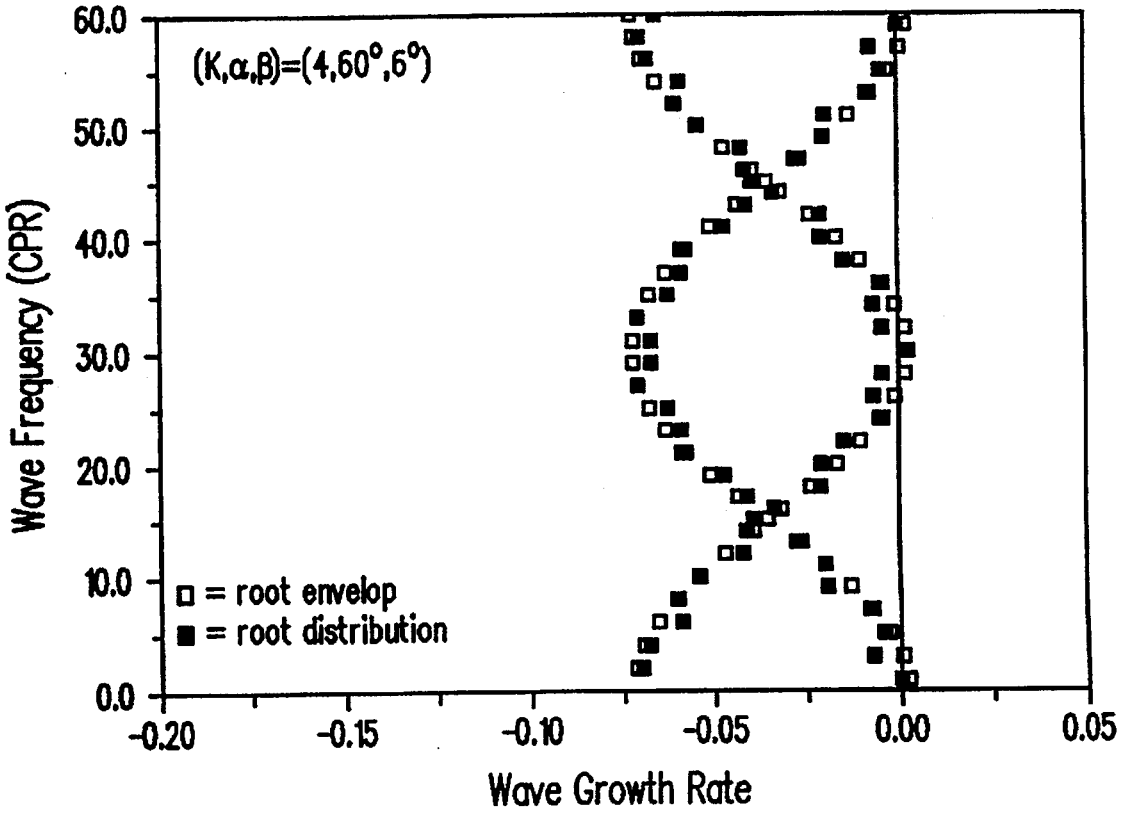
FIG. 20 is a graph of the root envelope.

FIG. 20 shows a comparison between the root distribution and the root envelope. It is evident that, for all practical purposes, the root envelope characterizes the locations of the lobing loop characteristic roots in the u-plane. The advantage is that the root envelope is simply defined by the three parameters $(\tau_n, \delta, n_{pk})$, which are functions of the setup angle $\beta$ only. For all practical purposes, the root envelope can be used as a reference for the development of lobing control methodologies.

The characteristic roots may be approximated by using a Taylor series expansion method. Previously, it has been shown that the characteristic root can be expressed in terms of the sum of the integer portion j(i) and the fractional portion $\mu_i$, and the fractional portion of the root is limited within the root neighborhood ($\delta_{min} < \delta_i < \delta_{max}$, $\eta_{lim} < \eta < \eta_{lim}$). This leads to the simplification of the characteristic equation by utilizing Taylor series expansion.

Since the characteristic roots are in the small root neighborhood of the respective integer portions of the roots, the transcendental terms in the characteristic equation Equation 21 can be expanded into Taylor series at the respective integer portions j(i) as follows:

$$e^{-2\pi\mu_i} = 1 - 2\pi\mu_i + \frac{(2\pi\mu_i)^2}{2!} \cdots \tag{44}$$

$$e^{-2\alpha\mu_i} = \left[ 1 - \alpha\mu_i + \frac{(2\alpha\mu_i)^2}{2!} \cdots \right] e^{-j\alpha i}$$

$$e^{-(\pi-\beta)\mu_i} = \left[ 1 - (\pi-\beta)\mu_i + \frac{[(\pi-\beta)\mu_i]^2}{2!} \cdots \right] e^{-j(\pi-\beta)i}$$

For practical significance of the characteristic roots, only finite number of terms in Taylor series are needed to approximate the above transcendental terms. Thus, the characteristic equation with transcendental terms can be simplified to characteristic equations of polynomial nature. From these simplified characteristic equations, the characteristic roots can be analytically solved with minimum computational efforts.

Because of the mildness of the lobing instability, lobes generated on the workpiece surface typically under certain periodic grinding disturbances, e.g., wheel imbalance. In this case, the lobing stability of the process is a function of the lobing frequency and the setup angles. From a practical viewpoint, it is desirable to define a parameter which describes the inherent lobing stability and is independent of these process parameters, the lobing frequency and the setup angles. The Nominal Growth Rate serves that purpose.

Further examination of Equations 33 and 34 reveals that the boundary values $\delta_{max}$, $\delta'_{max}$, $\delta'_{min}$ and $\delta_{min}$ are mainly decided by the two terms $K_1e^{-\alpha\delta}$ and $K_2e^{-(\pi-\beta)\delta}$, which are effects from the support blade and regulating wheel respectively. The nominal growth rate is defined as the growth rate when no effects from the support blade and the regulating wheel are present. The corresponding growth rate of this special case can be obtained as $$\delta_n = -\frac{1}{2\pi} \ln\left(\frac{K+1}{K}\right) \tag{45}$$

To properly setup a centerless grinding process, two steps are critical: (1) selecting a proper wheel/work combination; and (2) selecting a proper set of setup angles. Nominal growth rate provides a guideline for the selection of a proper wheel/work combination. FIG. 17 shows the relationship between the nominal growth and the cutting ratio.

Currently, the selection of the grinding and regulating wheels in centerless grinding is an experience based procedure. It demands specially trained and experienced workers to make proper wheel selections for specific workpiece and process requirements. With the increasing popularity of the superabrasive wheels and hard to grind materials (e.g., ceramics), the task of wheel selection becomes more and more challenging. Improper selections could be costly in terms of both time and materials.

The Nominal Growth Rate Method proposed for selecting grinding and regulating wheels is based on the concept of nominal lobing growth rate $\delta_n$ and relative lobing instability $\delta_{max}$. Since the nominal growth rate is independent of the setup angles, and the relative lobing instability is minorly effected by setup angles, this method essentially decouples the wheel selection process from the setup angle selection process. Thus, it significantly alleviates the complications involved in the wheel selection process.

As previously discussed and as shown in FIG. 16, all the characteristic roots of the lobing system are restricted within the growth rate interval $[\delta_{min}, \delta_{max}]$, which is specified by the lower growth rate limit $\delta_{min}$ and the upper growth rate limit (or relative lobing instability) $\delta_{max}$. Since the upper growth rate limit is always to the right side of, but very close to the imaginary axis of the complex u-plane; the growth rate interval $[\delta_{min}, \delta_{max}]$ can be closely approximated by the nominal growth rate interval $[2\delta_n, 0]$ specified by the nominal growth rate $\delta_n$. The only roots excluded from the interval $[2\delta_n, 0]$, but significant to the lobing system performance, are the unstable roots located in the small interval $[0, \delta_{max}]$. Because of the sparseness and the relative weakness of the unstable characteristic roots, the effect of these unstable roots can be characterized by the relative lobing instability $\delta_{max}$. This leads to the development of the Nominal Growth-Rate Method for selecting the grinding and regulating wheels based on the nominal growth rate $\delta_n$.

The Nominal Growth-Rate Method suggests the selection of the grinding and regulating wheels so that the resulting nominal growth rate satisfies the process lobing stability requirements, while the relative lobing instability is kept at an acceptable level. It is not feasible to select a set of setup angles $(\alpha,\beta)$ so that the relative lobing stability at the frequencies of the present grinding disturbances is below the nominal growth rate. Therefore, it is desirable to keep the nominal growth rate low in selecting the grinding and regulating wheels, so long as the relative lobing instability is acceptable.

The chief advantage of selecting the wheels based on the nominal growth rate is its simplicity. The nominal growth rate is a function of only the cutting ratio, and it is relatively independent of the setup angles. It can be easily calculated from Equation 45 as $$\delta_n = -\frac{1}{2\pi} \ln\left[\frac{K+1}{K}\right] \tag{45}$$

As can be seen in FIG. 17, the nominal growth rate increases with the increasing cutting ratio. Thus, based on the nominal growth rate, it is advantageous to select the grinding and regulating wheels that lead to a lower cutting ratio K.

On the other hand, the relative lobing instability also requires consideration of the wheel selection process. The relative lobing instability $\delta_{max}$ can be calculated from Equation 33 as $$K[e^{\delta_{max}}]^{-2\pi} + K_1[e^{\delta_{max}}]^{-\alpha} + K_2(e^{\delta_{max}})^{-(\pi-\beta)} = K+1 \tag{46}$$

Figure 21:
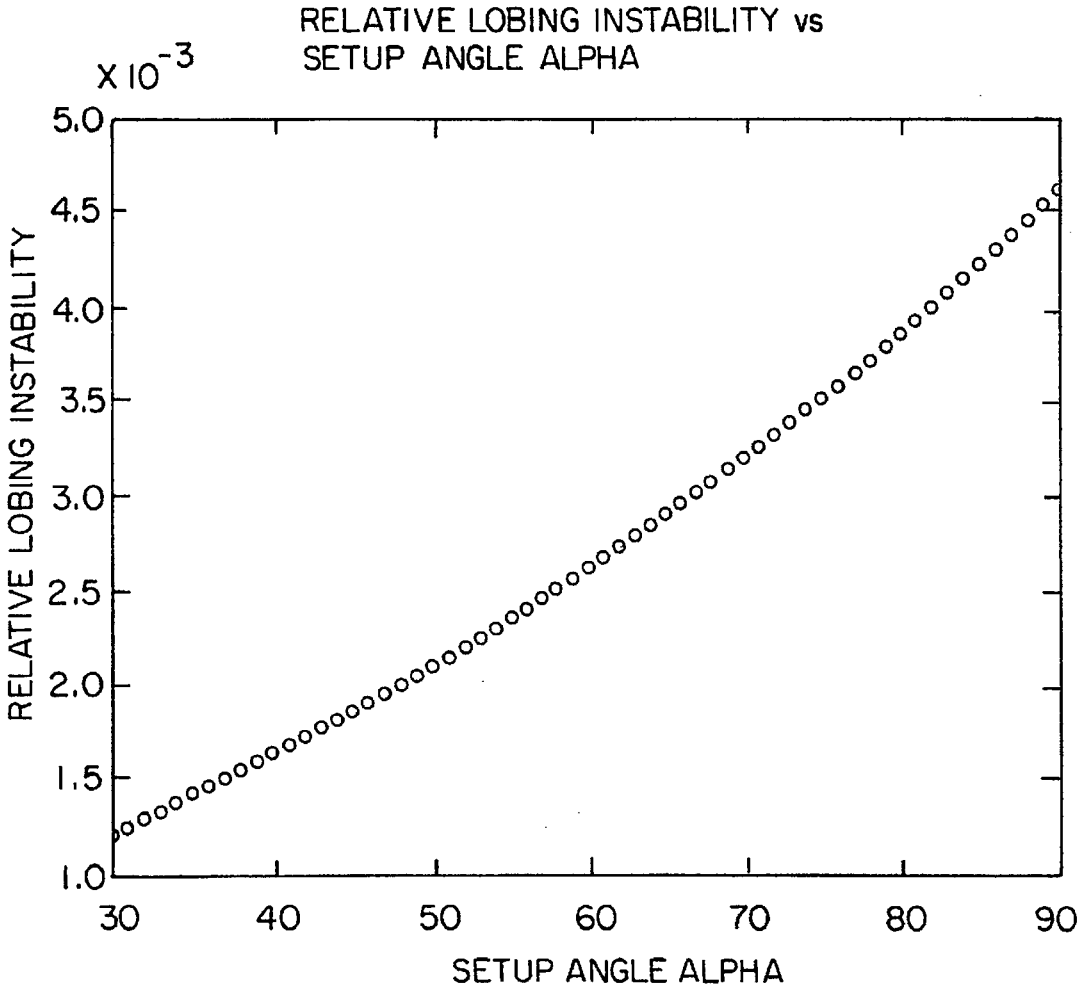
FIG. 21 is a graph of relative lobing instability versus α-setup angle.
Figure 22:
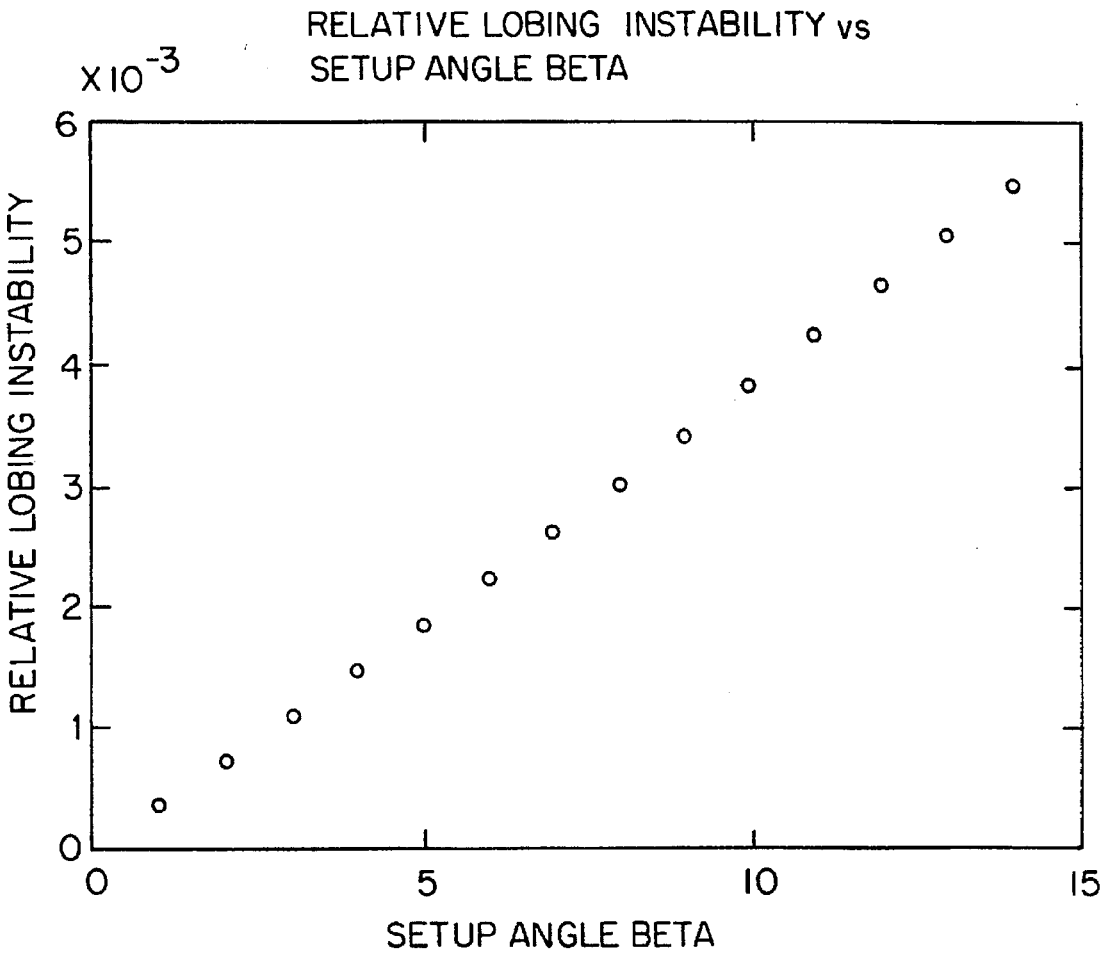
FIG. 22 is a graph of relative lobing instability versus β-setup angle.
Figure 23:
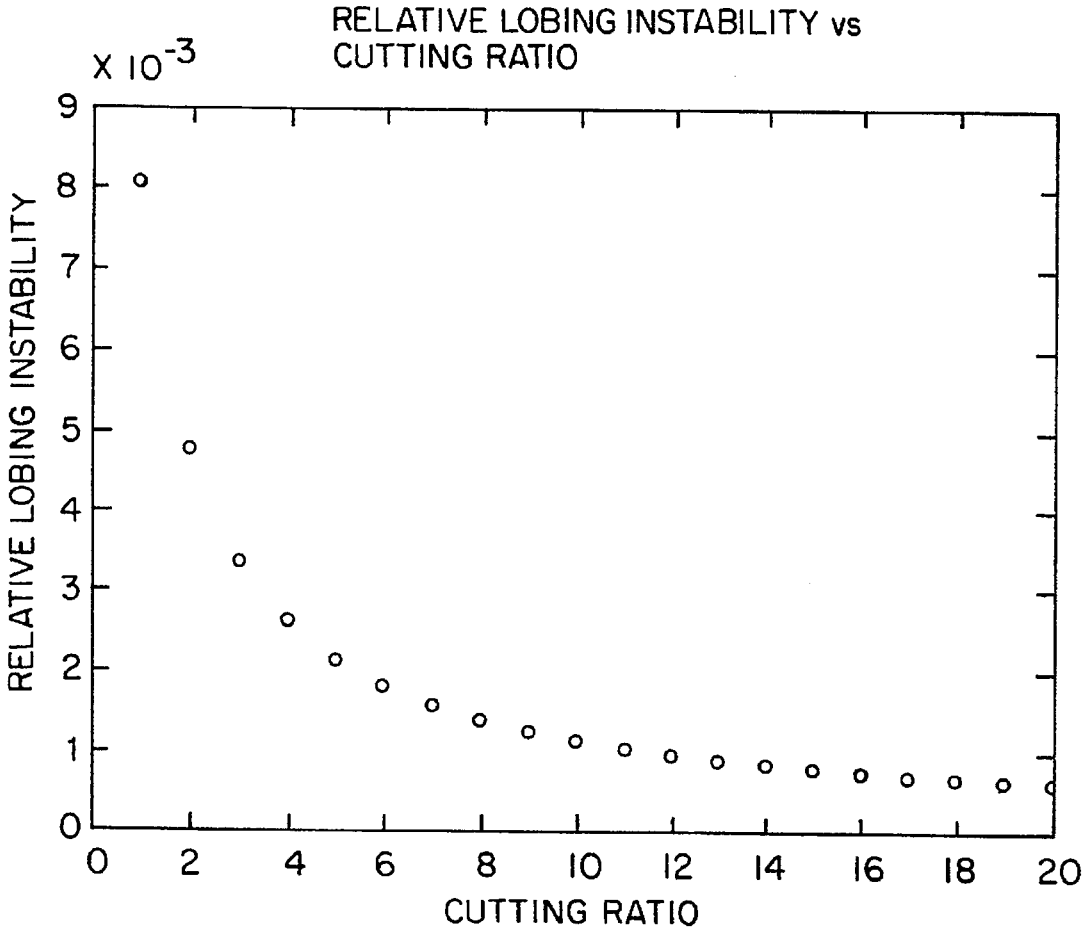
FIG. 23 is a graph of relative lobing instability versus cutting ratio.

The weak dependence of $\delta_{max}$ on the setup angles $(\alpha,\beta)$ has been demonstrated in FIG. 21, and, as shown in FIG. 22, the cutting ratio K is the predominant factor affecting the relative lobing instability. FIG. 23 shows that the relative lobing instability increases as the cutting ratio increases, and a small cutting ratio will result in high relative lobing instability.

A proper selection of the grinding and regulating wheels is a compromise between the nominal growth rate and the nominal lobing instability. In general, if the grinding disturbances are of wide-band noise nature, the nominal lobing instability requires close observation. If the grinding disturbances present one or more dominant frequencies, the nominal growth rate must be kept low, as long as the nominal lobing instability is acceptable.

Figure 24:
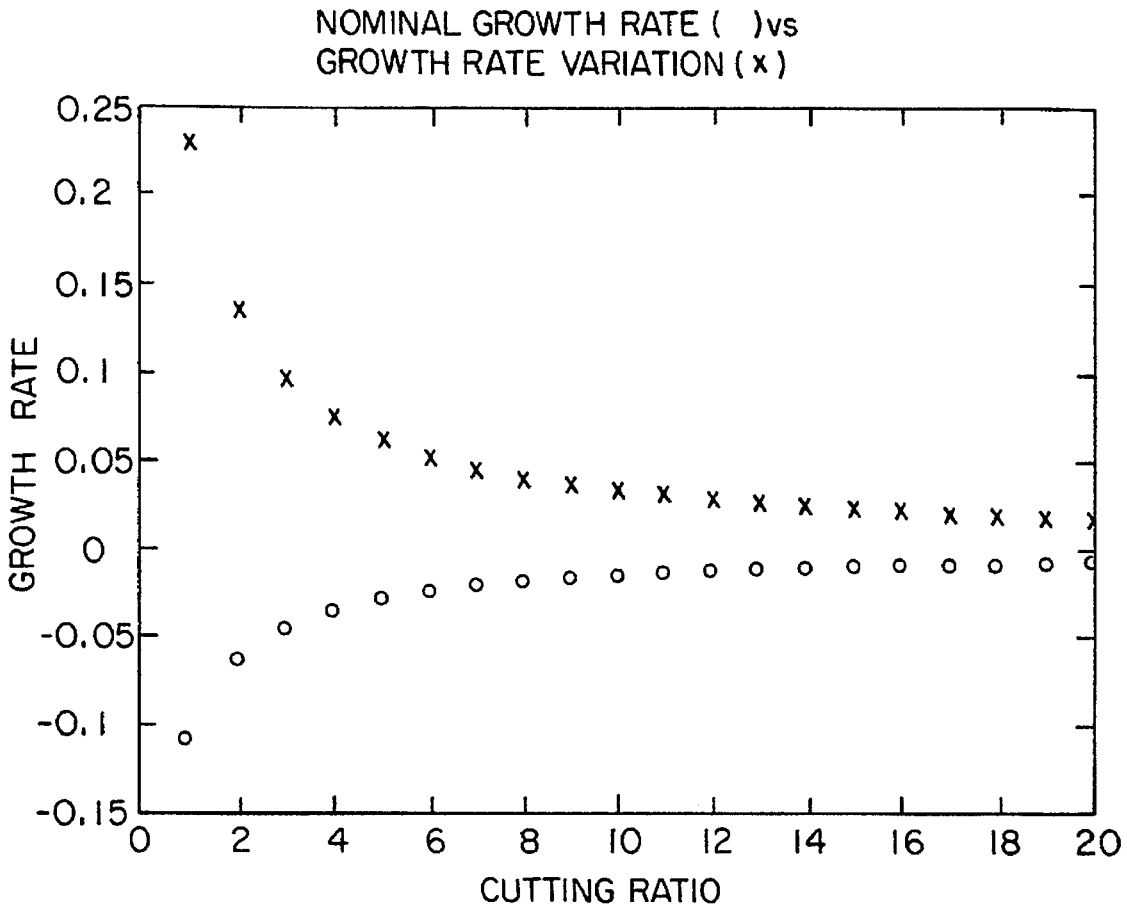
FIG. 24 is a graph of nominal growth rate and growth rate variation versus cutting ratio.

FIG. 24 shows the variations of the nominal growth rate as the cutting ratio varies in the range of 1 to 20. The nominal growth rate increases and the nominal lobing instability decreases as the cutting ratio increases. Since the actual lobing instability can be improved by selecting the proper setup angles $(\alpha,\beta)$, the main focus in selecting the grinding and regulating wheels is on the nominal growth rate. Typically, a cutting ratio in the range of 2 to 6 is a good starting value in selecting the wheels for general centerless grinding applications.

The following example is provided to illustrate the process of wheel selection using the Nominal Growth-Rate Method. For the purpose of illustration, the following typical contact stiffness values are assumed for centerless grinding of solid bearing steel components with using a vitrified grinding wheel along with a rubber bonded regulating wheel.

$k_w$=5N/μm/mm $k_{cs}$=5N/μm/mm $k_{cr}$=1.25N/μm/mm $K_{cw}=\infty$

Substituting the above values into Equations 7 and 45, the cutting ratio and nominal growth rate are obtained as follows:

K=5

$\delta_n=-0.029$

To verify check the corresponding nominal lobing instability, a typical set of the setup angles $(\alpha,\beta)=(60°,7°)$ is assumed. The nominal lobing instability can be calculated from Equation 33.

$\delta_{max}=0.00383$

FIG. 17 is obtained by plotting the calculated nominal growth rate on FIG. 24. Clearly, the assumed wheel/workpiece combination is within the recommended region for general centerless grinding applications.

The Pole Arrangement Method optimizes the workpiece setup by selecting a proper setup angle β so that all significant grinding disturbances are restricted within the smallest of possible preferable regions. Because the insignificant roots within the preferable regions have higher attenuation rates, a minimum workpiece roundness error can be anticipated.

Figure 25:
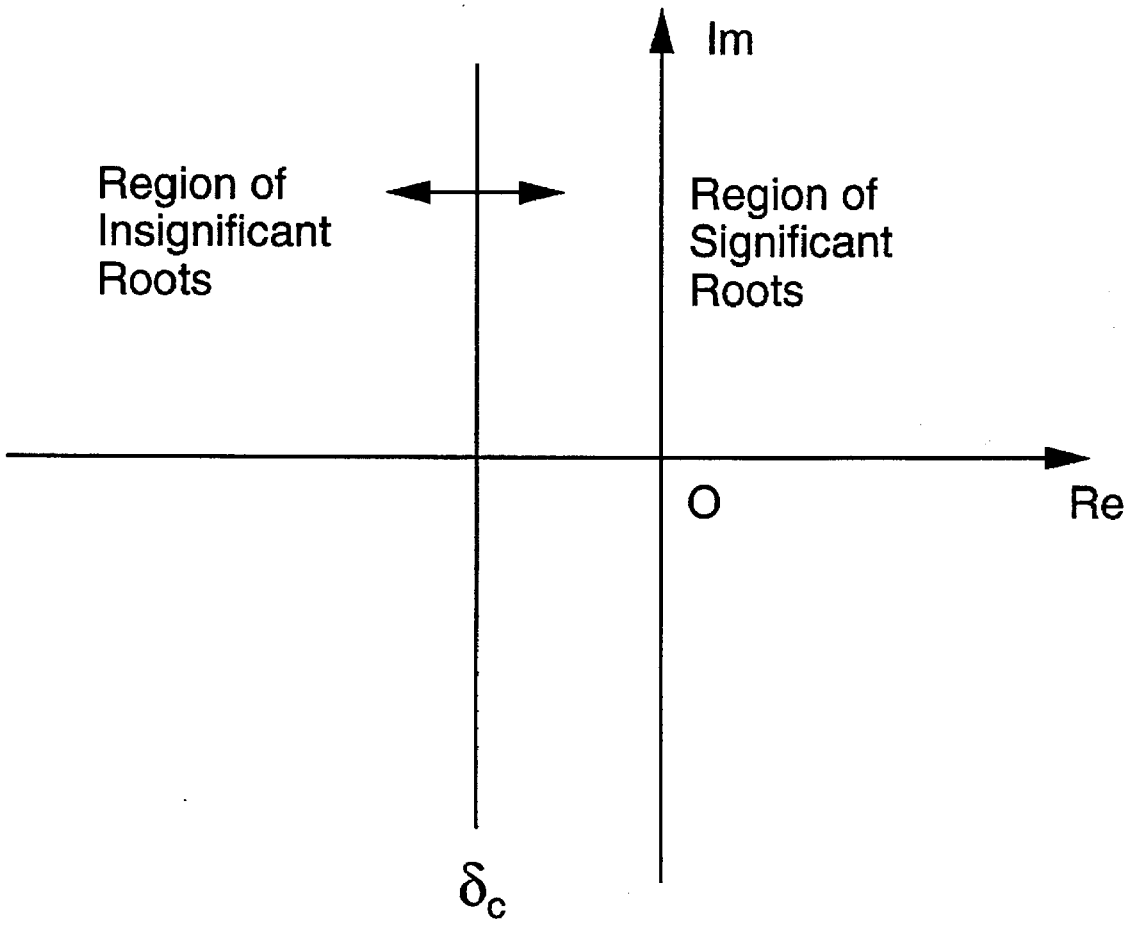
FIG. 25 is a diagrammatic illustration of characteristic root locations in the complex u-plane.

Knowing the relation between the locations of the characteristic roots and lobing system performance, the complex u-plane can be divided into two regions: the region of significant roots and the region of insignificant roots (FIG. 25). The wave growth rate that separates these two regions is called the critical wave growth rate $\delta_c$. The insignificant roots refer to the characteristic roots that are located to the left side of the critical wave growth rate, while the significant roots are located on or to the right side of the critical wave growth rate. The determination of the critical wave growth rate $\delta_c$ is based on the lobing stability requirement of the grinding process.

The significant roots consist of: (1) those roots located to the right side of the imaginary axis, and (2) those roots located between the critical wave growth rate and the imaginary axis. The roots located to the right side of the imaginary axis are unstable and obviously unsuitable for lobing suppression. The second type of roots are stable, but offer very little attenuation to potential grinding disturbances because of the closeness of these roots to the imaginary axis. It is desirable to avoid them as well. Thus, the significant roots are undesirable for lobing suppression.

It is recommended to select a machine setup such that potential grinding disturbances excite only the insignificant roots during grinding. Because the wave growth rates of insignificant roots are lower than the critical wave growth rate $\delta_c$, these insignificant roots offer higher attenuation rates to the lobing response, leading to a smaller workpiece roundness error. The wave frequency intervals containing only the insignificant roots are called preferable regions.

Figure 26:
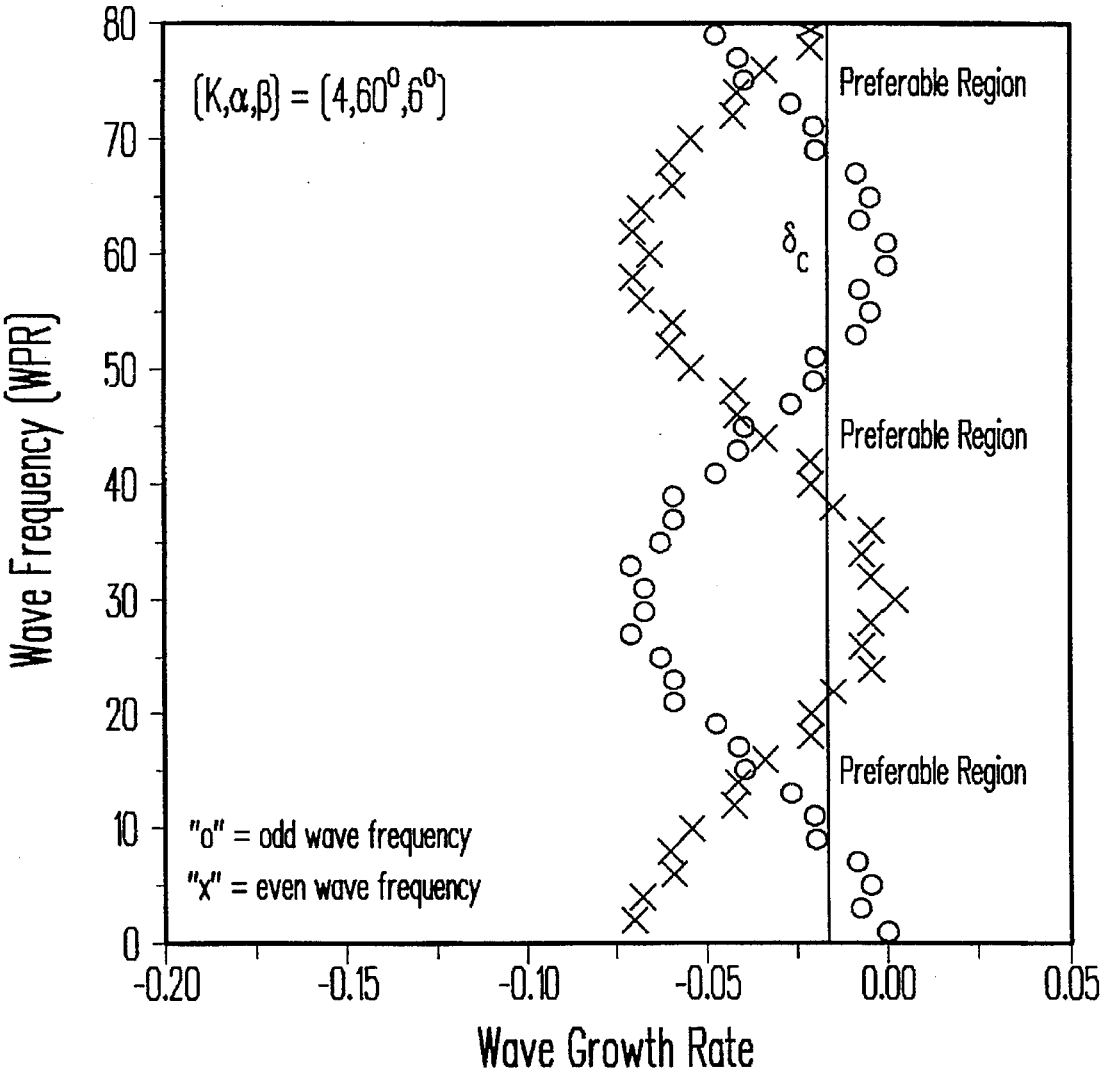
FIG. 26 is a graph of wave frequency versus wave growth rate indicating preferable regions.

Considering the same machine setup previously discussed, $(K,\alpha,\beta)=(4,60°,6°)$, FIG. 26 identifies the locations of the preferable regions for a selected critical growth rate of −0.01643, which is located midway between the mean wave growth rate and the upper growth rate boundary ($\delta_{max}$). It is important to note that the preferable regions are always located around the respective preferable frequencies and the size of these preferable regions depends on the value of the critical wave growth rate. It is not feasible to select a critical wave growth rate that is smaller than the mean wave growth rate.

Figure 27:
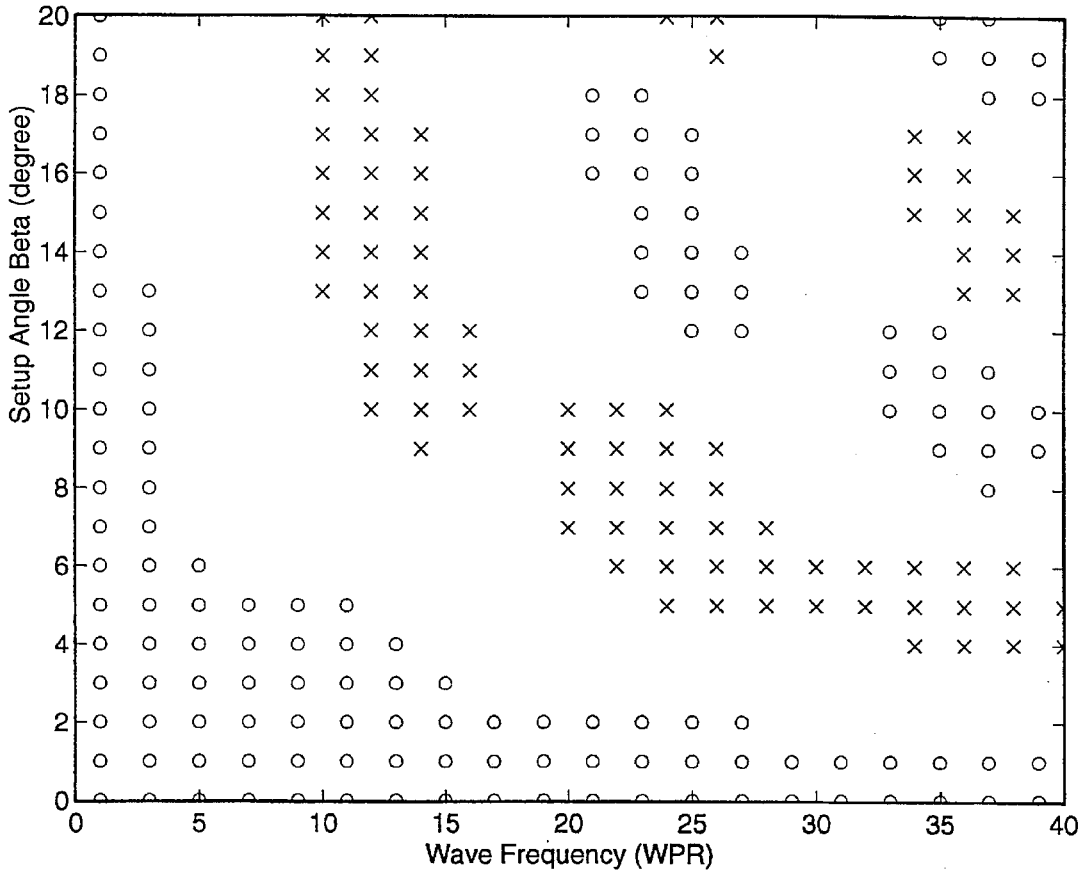
FIG. 27 is a graph of β-setup angle versus wave frequency indicating relative stability zones.

For a selected critical wave growth rate, a relative stability diagram can be created by identifying the locations of the preferable regions for a given range of setup β. FIG. 27 shows a relative stability diagram created based on the following conditions:

$K=4;\ \delta_n=-0.01643;$ $\alpha=60°;\ 0°<\beta<20°.$

In the diagram, the preferable regions are identified as unshaded areas, while the significant roots with odd wave frequencies are indicated by "o" and the significant roots with even wave frequencies are indicated by "x". It is desirable to select a setup angle β such that all potential grinding disturbances are restricted only within the unshaded preferable regions.

The locations of the preferable regions in the relative stability diagram are generally effected by the machine setup $(K,\alpha,\beta)$. Since the setup angle α and the cutting ratio K have a secondary influence on the distribution of the characteristic roots, they also have a minimum influence on the locations of the preferable regions. For practical purposes, the locations of the preferable regions can be regarded as invariant for small variations of the setup angle α and cutting ratio K, thus, one relative stability diagram can be used for reasonable ranges of α and K. Moreover, the selection of the setup angle β becomes more restrictive as the critical wave growth rate $\delta_c$ decreases.

In order to minimize the lobing response, it is desirable to select a setup angle β such that the prevailing grinding disturbances excite no characteristic roots, or only those remote from the imaginary axis. From a practical perspective, it is important to select a setup angle β, so that the lobing response is relatively stable for a reasonable wave frequency span around the grinding disturbances.

A further examination of FIG. 19 reveals that, between any two consecutive peak wave frequencies, there is a wave frequency span where the characteristic roots with both odd and even wave frequencies are relatively stable. These frequency spans are centered at the preferable wave frequencies determined by Equation 37.

The Pole Arrangement Method suggests the selection of a proper setup angle β so that the predominant grinding disturbances are located as close as possible to the preferable wave frequencies. Because both even and odd roots near these preferable wave frequencies are relatively stable, a lower lobing response can be anticipated, which leads to less workpiece roundness error.

The pole arrangement method involves combining the distribution of the characteristic roots and the grinding disturbances to determine the response of the lobing loop system. Next, the preferable wave frequencies of the distribution of the characteristic roots having relative low growth rates are determined based upon the β setup angle. The β setup angle is then adjusted so that the preferable wave frequencies are at or near the frequencies of the grinding disturbances, and the distribution of the characteristic roots of the characteristic equation are determined in terms of the frequency and the growth rate of the surface waves of the lobing loop system. This distribution of characteristic roots is combined with the grinding disturbances to determine the response of the lobing loop system, which, in turn, is compared with the response determined earlier.

The process of determining the β setup is repeated until the response is minimized.

To illustrate the application of the pole-arrangement method, a centerless grinding process with the following process information is assumed:

Process Parameters:

$$K=4;\ \alpha=60°$$

Grinding Disturbance Frequency Span:

$$22\ \text{CPR} \leqq n_d \leqq 26\ \text{CPR}$$

For a typical setup angle β=6°, which is widely used in the industry, the wave growth rate associated with the characteristic roots varies from −0.015 at 22 CPR to −0.0069 at 26 CPR. FIG. 19 shows that the grinding disturbance frequency span is relatively far away from the preferable wave frequencies.

Figure 28:
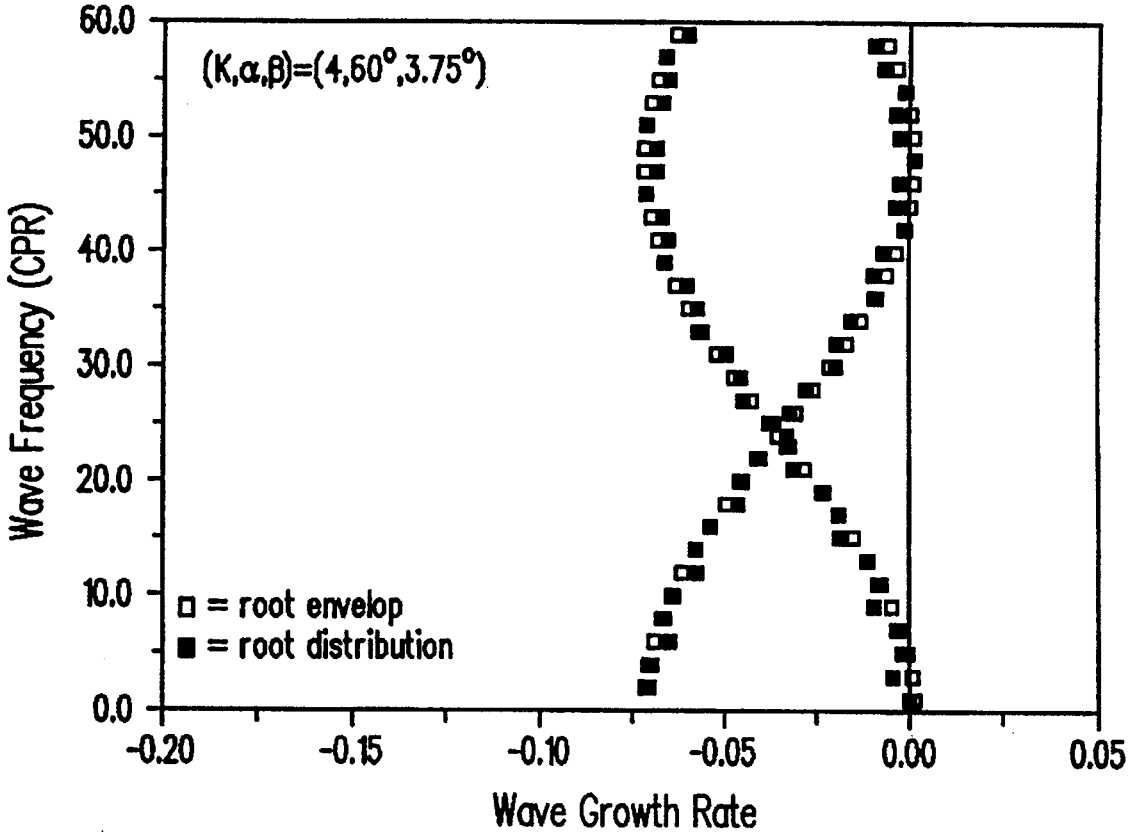
FIG. 28 is a graph of the root envelope.
Figure 30A:
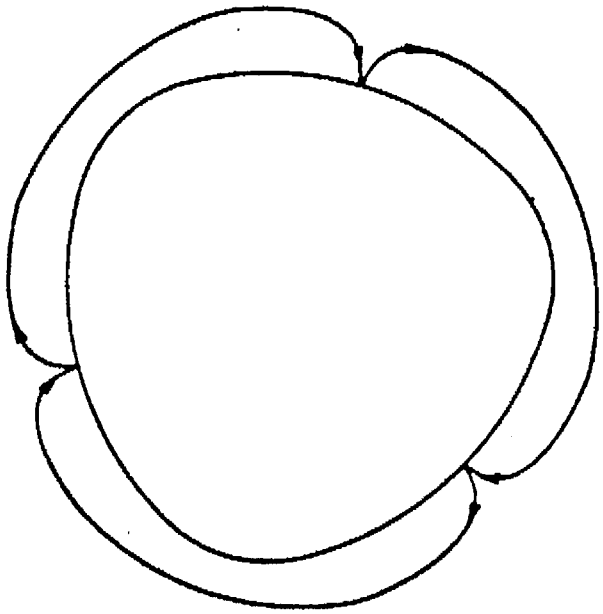
FIG. 30(*a*) is a diagrammatical illustration of a standing wave in a workpiece.
Figure 30B:
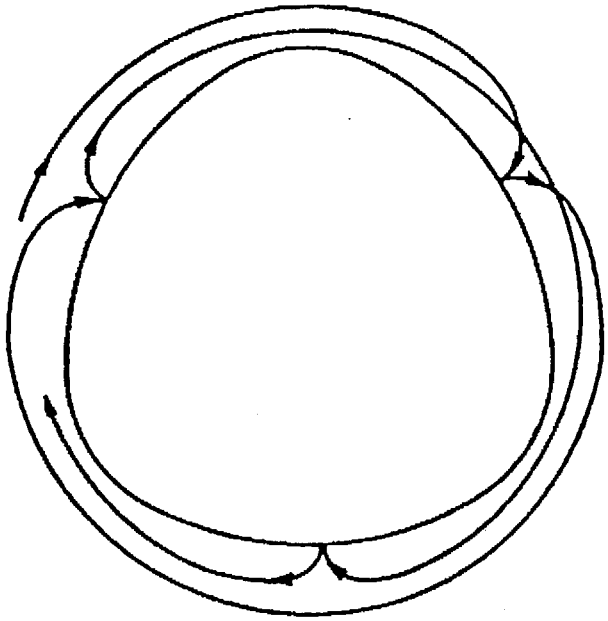

By using the Pole Arrangement Method, the center of the disturbance frequency span is arranged at the preferable wave frequency (π/2β). This yields a setup angle of β=3.75°. Accordingly, the wave growth rate for this setup varies between −0.041 and −0.032 for the specified disturbance frequency span. FIG. 30 shows the corresponding root distribution and root envelop. Comparing FIG. 28 with FIG. 20, the improvement of relative lobing stability within the disturbance frequency span is evident.

The Speed Ratio Regulation Method is to properly regulate the workpiece rotational speed so that the workpiece roundness error is minimized by maximizing the workpiece surface wave interference.

When the lobing loop is stable within a wave frequency bandwidth of potential grinding disturbances, a steady-state lobing response can be achieved. In this case, harmonic analysis techniques can be utilized to predict the magnitude of the lobing response. The frequency response function of steady-state lobing response is obtained by setting u=jn in Equation 21:

$$\frac{R}{X}(jn)=\frac{1}{K(1-e^{-j2\pi n})+(1-K_1e^{-j\alpha n}+K_2e^{-j(\pi-\beta)n})} \tag{47}$$

Figure 29:
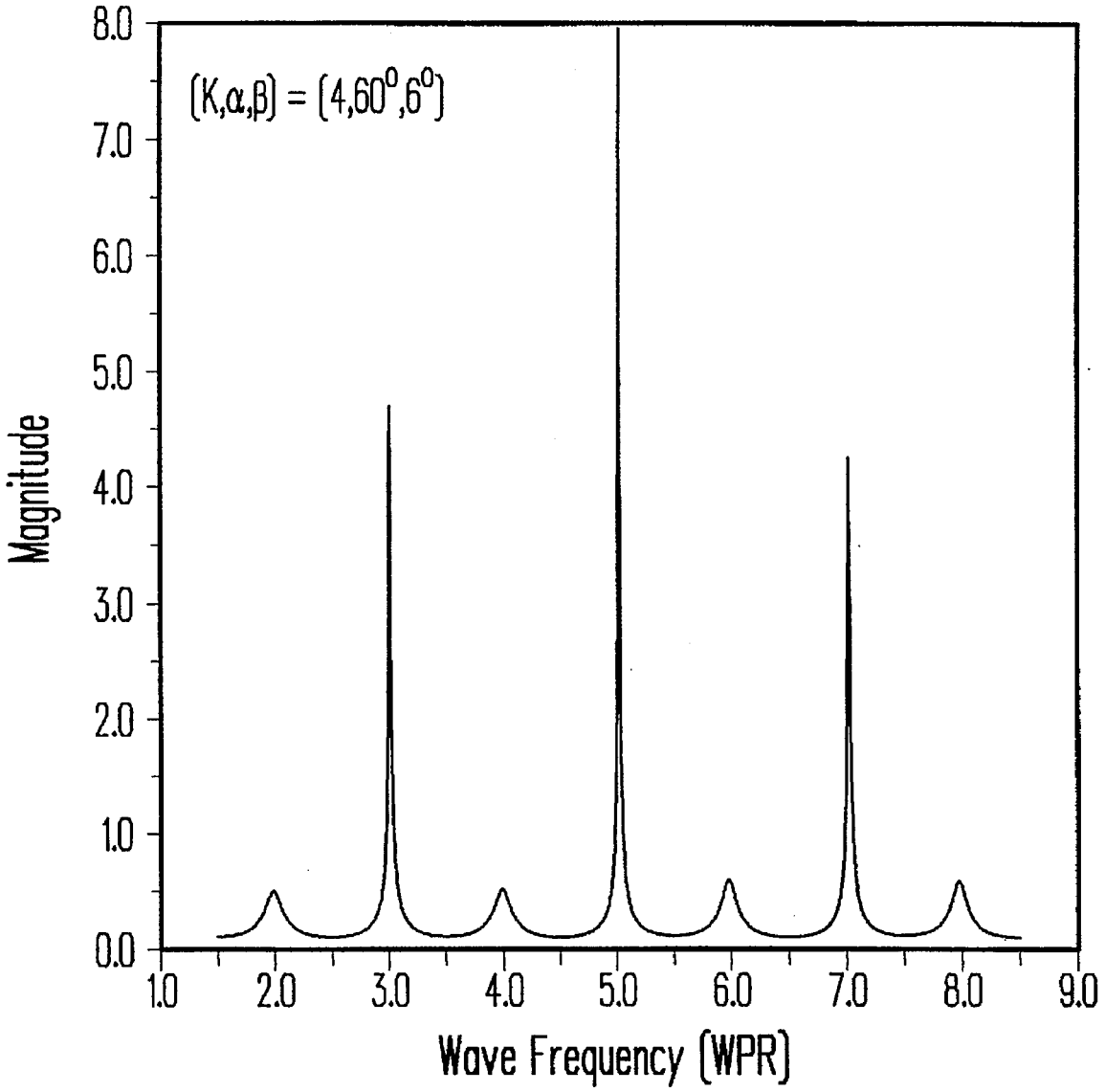
FIG. 29 is a graph of grinding disturbance magnitude versus wave frequency.

A magnitude plot of Equation 47 over a wave frequency range of 1.5 through 8.5 WPR is shown in FIG. 29. As FIG. 29 shows, all peak wave frequencies are in the close proximity of the respective integer wave frequencies and, further, the lobing response is more stable at noninteger wave frequencies than that at integer wave frequencies. This is a result of wave interference on the workpiece surface.

When the wave frequency of a grinding disturbance is an integer number, the phase angle between the surface wave being generated and the wave generated one workpiece revolution earlier is zero. The existing wave on the workpiece surface is reinforced in each consecutive workpiece revolution as seen in FIG. 30(*a*), and consequently the corresponding centerless grinding process is less stable at that wave frequency. In this case, the surface wave formed on the workpiece surface appears stationary and is called a standing wave.

When the wave frequency of a grinding disturbance is a noninteger number, the phase shift angle between successive revolutions is no longer equal to zero. The current surface wave precesses by an amount corresponding to the revolution phase shift. This type of workpiece surface wave is called a precessing wave seen in FIG. 30(*b*)). The precessing wave is considerably more stable than the standing wave, because the current precessing wave geometrically interferes with the existing wave on the workpiece surface resulting in partial surface wave cancellation. This phase shift benefit is maximized around a 180° phase shift. For this reason, since there exists a strong likelihood of surface wave generation, it is advisable to set up a centerless grinding operation such that only precessing waves are generated during grinding.

The Speed Regulation method involves first determining the magnitude of the transfer function of the lobing loop system over a frequency range using harmonic analysis. Next, the magnitude of the transfer function is combined with the grinding disturbances to determine the response of the lobing loop system including the magnitude, frequency and phase of the dominant waves in the response. The rotational speed ratio corresponding to the frequency of the grinding disturbance resulting from grinding wheel imbalance is then determined and adjusted to shift the phase of the grinding disturbance to generate precessing waves which cancel the dominant waves and further minimize the workpiece roundness error.

Figure 31:
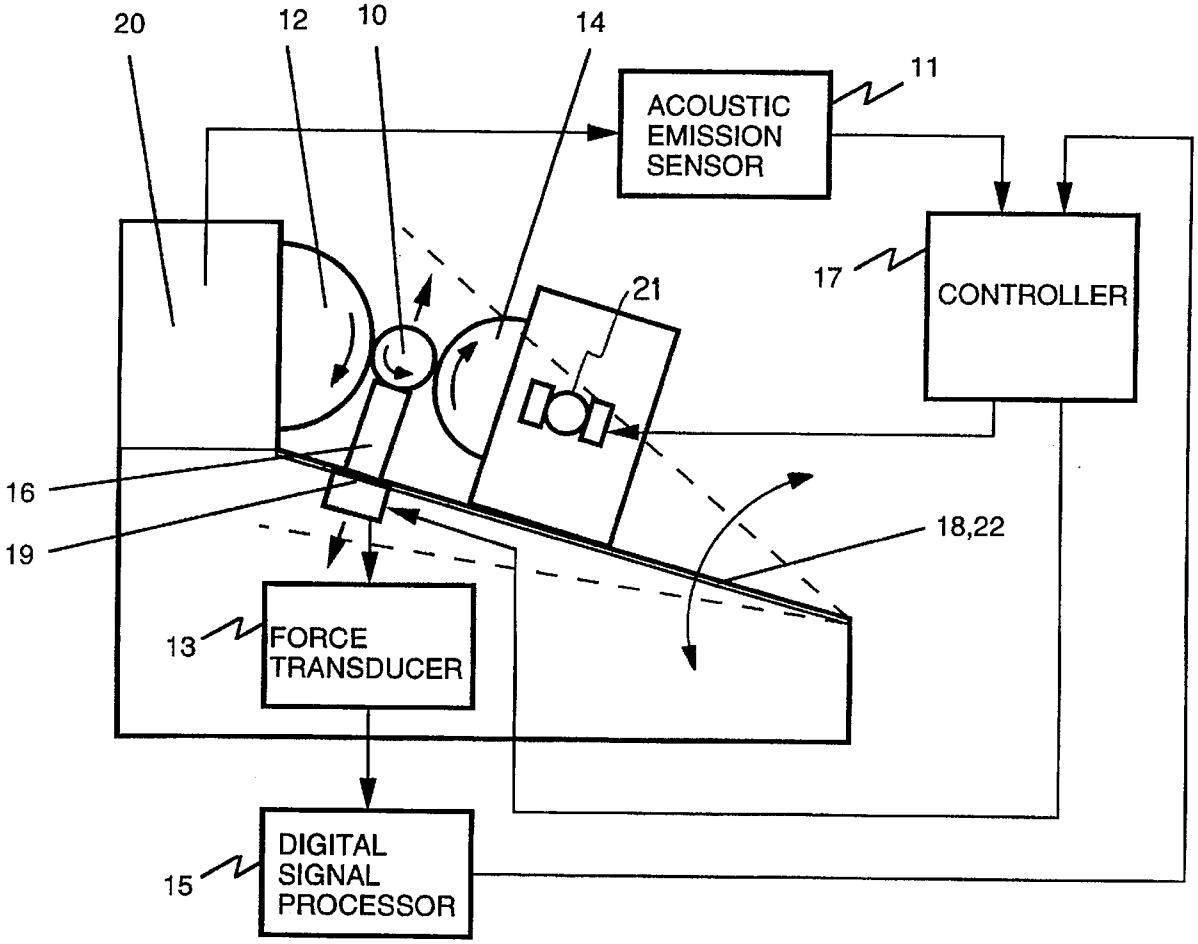
FIG. 31 is a side view of one embodiment of apparatus used in the method of the present invention with a block diagrammatic illustration of the sensor and control system.

A centerless grinding machine may be designed to provide a full capability for setting up or optimizing a centerless grinding process based on novel methods of the present invention as illustrated in FIG. 31. This grinding machine may consist of a grinding wheel 12 in a stationary housing 20 to provide high machine stiffness and structural stability. A single slideway 22 carrying both the regulating wheel 14 and an adjustable support blade 16 provides accurate grinding cycle control and high structural stability. Use of only a single slideway 22 also results in significant cost savings in the construction of the centerless grinder.

The adjustable support blade fixture 16 can be adjusted vertical or horizontal to the upper surface of the machine bed. The horizontal adjustment is carried out manually to compensate for the workpiece size, and the vertical adjustment is provided to set up the workpiece to the desired workpiece center height either manually or automatically. Moreover, the adjustable support blade 16 has a flat upper surface so that the workpiece center height may be accurately determined. The blade may be adjusted low enough to allow the grinding wheel to dress the regulating wheel with an acoustic emission sensor 11 installed to detect the grinding wheel regulating wheel contact in order to provide complete conformity between the grinding wheel surface and the regulating wheel surface.

In order to properly support the workpiece using a flat blade, however, it is necessary to tilt the bed 18 from a level position. Thus, the bed 18 is designed to be tilted between 15° and 45° so that a component of the force of gravity on the workpiece opposes lateral movement.

A force transducer 13 may be attached to the base of the support blade 16 to detect grinding disturbances, and a digital signal processor 15 may determine the magnitude and the frequency of said grinding disturbances and transfer these results to the computer which operates the centerless grinder controller 17.

This machine may consist of a CNC controller programmed to perform the steps of the present invention as shown in FIG. 1, based on the process information and grinding disturbances. The initial process information can be provided to the CNC controller automatically via sensor feedbacks or manually via operator input. According to the workpiece setup specifications calculated by the CNC controller, the adjustment of the blade height may be accomplished by automatically controlled actuators 19 or manually by the operator. Once the workpiece is properly set up, further adjustment of the workpiece setup is generally not needed during grinding. Once the proper workpiece setup is in place, the workpiece rotational speed can be continuously controlled to reduce surface waves by controlling the speed of the regulating wheel motor 21.

Thus it can be seen that the method and the apparatus of the present invention provide a novel system approach to lobing suppression in a centerless grinding system (lobing system) in which the resulting lobing response to the grinding disturbances is minimized.

Having thus described the invention, what is claimed is:

1. In a method for minimizing the roundness error in a workpiece having a generally circular periphery during centerless grinding of the workpiece in a grinding machine having a bed mounting a grinding wheel and two spaced workpiece supports, the steps comprising:

(i) rotatably supporting a workpiece on the upper surface of a first workpiece support, between a grinding wheel and a second workpiece support, said first support rotatably supporting the workpiece in contact with said grinding wheel and said second support, with an d-setup angle being defined by a first imaginary line extending through the axis of said grinding wheel and the workpiece and a second imaginary line extending through the axis of the workpiece and the point of contact with said first support, and a β-setup angle being defined by said first line and a third imaginary line extending across the axis of the workpiece and the point of contact with said second support, and α-setup angle and β-setup angle cooperating with a cutting ratio to define the transfer function of a lobing loop system in a complex s-plane;

(ii) determining the characteristic equation of said transfer function of said lobing loop system;

(iii) transforming said characteristic equation from said complex s-plane to the complex u-plane so that the frequency and the growth rate of the surface waves of said lobing loop system are independent of the workpiece rotational speed;

(iv) determining the distribution of the characteristic roots of said characteristic equation representing said lobing loop system in terms of the frequency and the growth rate of said surface waves of said lobing loop system;

(v) rotating said grinding wheel and rotating said workpiece against the grinding surface of said grinding wheel;

(vi) detecting and determining the magnitude and frequency of grinding disturbances causing surface waves in said workpiece;

(vii) combining said distribution of said characteristic roots and said grinding disturbances to determine the response of said lobing loop system;

(viii) determining the preferable wave frequencies of said distribution of said characteristic roots having relative low growth rates based upon said β-setup angle; and (ix) adjusting said β-setup angle so that said preferable wave frequencies are at or near the frequencies of said grinding disturbances to minimize the workpiece roundness error by minimizing the response of said lobing loop system under said grinding disturbances.

2. The method for centerless grinding of a workpiece in accordance with claim 1 wherein there are included the steps of:

(i) determining said distribution of said characteristic roots of said characteristic equation representing said lobing loop system in terms of the frequency and the growth rate of said surface waves of said lobing loop system;

(ii) analyzing said distribution of said characteristic roots and said grinding disturbances to determine the response of said lobing loop system;

(iii) comparing the response determined in said step of combining said distribution of said characteristic roots and said grinding disturbances to the response found in said step of analyzing said distribution of said characteristic roots and said grinding disturbances; and (iv) if the response in said step of combining said distribution of said characteristic roots and said grinding disturbances is greater than the response in said step of analyzing said distribution of said characteristic roots and said grinding disturbances, repeating said steps of determining the preferable wave frequencies, adjusting said β-setup angle, determining said distribution of said characteristic roots, analyzing said distribution of said characteristic roots and said grinding disturbances, comparing the response, and repeating said steps.

3. The method for centerless grinding of a workpiece in accordance with claim 1 wherein said step of determining said distribution of said characteristic roots includes determining the upper and lower boundaries of the growth rate of said distribution of said characteristic roots using a bidiagrammatical method based upon the geometrical relationship between diagrams representing the regenerative cutting mechanism and the geometric rounding mechanism in said complex u-plane.

4. The method for centerless grinding of a workpiece in accordance with claim 3 wherein said step of determining the distribution of said characteristic roots includes determining said characteristic roots by approximating the nonlinear terms of said characteristic equation using a Taylor series expansion.

5. The method for centerless grinding of a workpiece in accordance with claim 2 wherein said step of determining the distribution of said characteristic roots includes determining said characteristic roots numerically.

6. The method for centerless grinding of a workpiece in accordance with claim 1 wherein there are included the steps of:

(i) determining the magnitude of said transfer function of said lobing loop system over a frequency range using harmonic analysis;

(ii) combining said magnitude of said transfer function with said grinding disturbances to determine the response of said lobing loop system including the magnitude, frequency and phase of dominant waves in said response;

(iii) determining the ratio of the rotational speed of said grinding wheel to the rotational speed of said workpiece corresponding to the frequency of the grinding disturbance resulting from grinding wheel imbalance; and (iv) adjusting said rotational speed ratio to shift the phase of said grinding disturbance of said grinding wheel within a span of one-half a wavelength of the frequency of the lowest of said dominant waves thereby generating precessing waves which cancel said dominant waves and further minimize the workpiece roundness error.

7. The method for centerless grinding of a workpiece in accordance with claim 6 whereby the step of adjusting the speed ratio includes continuously adjusting said speed ratio to shift the phase of said grinding disturbance within a span of one-half a wavelength of the frequency of the lowest of said dominant waves.

8. The method for centerless grinding of a workpiece in accordance with claim 1 wherein said first workpiece support is a blade support, and said second workpiece support is a regulating wheel.

9. The method for centerless grinding of a workpiece in accordance with claim 8 wherein said step of adjusting the β-setup angle includes adjusting the distance of said blade support from an imaginary line extending between the axis of said grinding wheel and the axis of said regulating wheel.

10. Apparatus for centerless grinding an associated workpiece having a generally circular periphery, comprising:

(a) a generally planar bed tiltable from a level position;

(b) a grinding wheel rotatably mounted on said bed;

(c) a regulating wheel rotatably mounted on said bed spaced from the periphery of said grinding wheel to permit an associated workpiece to be disposed therebetween;

(d) a support blade mounted on said bed intermediate said grinding wheel and said regulating wheel, said blade rotatably supporting the workpiece on its upper surface in contact with said grinding wheel and said regulating wheel whereby, when a workpiece is supported thereon, a workpiece center height is defined by the distance of the axis of the workpiece from a first imaginary line extending between the axis of said grinding wheel and the axis of said regulating wheel, and a blade top angle is defined by a second imaginary line parallel to said first imaginary line and passing through the point of contact between the workpiece and said support blade and a third imaginary line tangent to the upper surface of said blade, said blade top angle being approximately 0°;

(e) means for determining the characteristic equation of a transfer function of a lobing loop system in the complex s-plane, said transfer function of said lobing loop system being defined by said blade top angle, said workpiece center height, and a cutting ratio;

(f) means for transforming said characteristic equation from said complex s-plane to the complex u-plane so that the frequency and the growth rate of the surface waves of said lobing loop system are independent of the workpiece rotational speed;

(g) means for determining the distribution of the characteristic roots of said characteristic equation representing said lobing loop system in terms of the frequency and the growth rate of said surface waves of said lobing loop system;

(h) means for rotating the workpiece against the grinding surface of said grinding wheel as it rotates;

(i) means for detecting and determining the magnitude and frequency of grinding disturbances causing surface waves in the workpiece;

(j) means for combining said distribution of said characteristic roots and said grinding disturbances to determine the response of said lobing loop system;

(k) means for determining the preferable wave frequencies of said distribution of said characteristic roots having relative low growth rates based upon said workpiece center height; and (l) means for adjusting said workpiece center height so that said preferable wave frequencies are at or near the frequencies of said grinding disturbances to minimize the workpiece roundness error.

11. Apparatus for centerless grinding according to claim 10 wherein said means for adjusting said workpiece center height includes means for moving said support blade in the direction of said workpiece center height.

12. Apparatus for centerless grinding according to claim 11 wherein said means for detecting and determining the magnitude and frequency said grinding disturbances includes a digital signal processor for determining the magnitude and frequency of said grinding disturbances.

13. Apparatus for centerless grinding according to claim 11 wherein said blade top angle is approximately 0°, and said bed is tilted between 15° and 45° from a level position.

14. Apparatus for centerless grinding according to claim 13 wherein said grinding wheel is mounted on said bed in a stationary position, and includes means for moving said regulating wheel to vary the center to center spacing between said regulating wheel and said grinding wheel.

15. Apparatus for centerless grinding according to claim 11 wherein said blade means for moving said support blade lowers said support blade to allow said grinding wheel to dress said regulating wheel, and includes means for moving said regulating wheel to vary the center to center spacing between said regulating wheel and said grinding wheel, means for sensing contact between said grinding wheel and said regulating wheel.

16. In a method for minimizing the roundness error in a workpiece having a generally circular periphery during centerless grinding of the workpiece in a grinding machine having a bed mounting a grinding wheel, a blade support, and a regulating wheel, the steps comprising:

(i) rotatably supporting a workpiece on the upper surface of a blade support between a grinding wheel and a regulating wheel, said blade support rotatably supporting the workpiece in contact with said grinding wheel and said regulating wheel;

(ii) determining a nominal surface wave growth rate on the basis of a desired centerless grinding performance;

(iii) determining the cutting ratio corresponding to said nominal growth rate; and (iv) selecting said grinding wheel and said regulating wheel corresponding to said cutting ratio.

17. The method for centerless grinding of a workpiece in accordance with claim 16 wherein said step of determining the cutting ratio corresponding to said nominal growth rate includes determining said cutting ratio by:

(i) determining the amount of stock to be removed from said workpiece;

(ii) rotating said workpiece against the grinding surface of said grinding wheel as it rotates;

(iii) determining the actual amount of stock removed from said workpiece;

(iv) determining said cutting ratio based upon said amount stock to be removed and said actual amount of stock removed;

(v) determining the nominal growth rate based upon said cutting ratio; and (vi) repeating (i) through (v) if said nominal growth rate does not provide said desired grinding performance.

* * * * *